US005142473A

United States Patent [19]

Davis

[11] Patent Number: 5,142,473

[45] Date of Patent: Aug. 25, 1992

[54] SPEED, ACCELERATION, AND TRIM CONTROL SYSTEM FOR POWER BOATS

[76] Inventor: Dale R. Davis, 16505 Wilderness Rd., Poway, Calif. 92064

[21] Appl. No.: 231,761

[22] Filed: Aug. 12, 1988

[51] Int. Cl.[5] ..... B63H 5/12

[52] U.S. Cl. ..... 364/424.01; 364/431.01; 364/565; 440/1; 440/87

[58] Field of Search ..... 364/426.04, 434, 571.04, 364/571.05, 572, 432, 431.05, 431.01, 426.01, 424.01, 565; 73/861.65, 861.66; 440/1, 87, 53; 318/588; 123/352; 33/366

[56] References Cited

U.S. PATENT DOCUMENTS

| | | | |
|---|---|---|---|
| 3,164,023 | 1/1965 | Holderer | 73/516 LM |
| 4,318,699 | 3/1982 | Wenstadt et al. | 440/1 |
| 4,577,718 | 3/1986 | Ueno | 123/352 |
| 4,603,484 | 8/1986 | Strothmann | 33/366 |
| 4,718,872 | 1/1988 | Olson et al. | 440/1 |
| 4,739,485 | 4/1988 | Hayashi | 364/431.05 |
| 4,749,926 | 6/1988 | Ontolchik | 318/588 |
| 4,769,773 | 9/1988 | Shatto, Jr. | 364/432 |
| 4,778,414 | 10/1988 | Taguchi | 440/1 |
| 4,797,826 | 1/1989 | Onogi et al. | 364/426.04 |
| 4,824,407 | 4/1989 | Torigai et al. | 440/1 |
| 4,931,025 | 6/1990 | Torigai et al. | 440/1 |

*Primary Examiner*—Parshotam S. Lall
*Assistant Examiner*—Michael Zanelli
*Attorney, Agent, or Firm*—William C. Fuess

[57] ABSTRACT

A computer-based system controls (i) speed, (ii) speed and acceleration and/or (iii) trim. Trim control is responsive to sensed inclination. Inclination/acceleration is sensed by an inclinometer/accelerometer having an electrically conductive fluid that flows within a conduit. The fluid assumes different positions in its flow path under differing gravitational and acceleration forces. A multiplicity of pins, positionally arrayed along the fluid flow path within the conduit, electrically sense the presence, or absence, of the fluid at a corresponding position within its flow path. The same computer-based system otherwise used for speed, acceleration and/or trim control also serves as a safety system interactive with a human operator for the sequencing and control of activities during the launch, use, and recovery of the power boat. The system senses hook-up conditions and provides visual messages and audio alarms during the hauling out of a trailered power boat from the water onto its land trailer and/or the launching of the power boat into the water from the same trailer. Similarly, the system interprets other sensors to support processes of hauling the boat out of the water onto its trailer, hoisting of the boat onto a hoist, in-water startup of the boat, launching of the boat from its trailer while both the boat and the trailer are in water, starting or restarting the boat's engine, and test or maintenance of the boat on land.

14 Claims, 27 Drawing Sheets

| MONITOR SENSORS | RPM (1=ENGINE ON) | BOW HOOK (1=BOW HOOK ON) | STERN HOOKS(2) (1=STERN HOOKS ON) | LEL (1=EXPLOSIVE CONDITION) | BILGE PLUG (1=PLUG IN) | TRAILER POSITION (1=PROP IN TRAILER POS.) | TRIM POSITION (1=TRIM UP, 0=DN) | |
|---|---|---|---|---|---|---|---|---|
| TEST AND MAINT. SEQ. 2800 | d | d | d | d | d | d | d | → NOT ENTERED VIA MONITOR MODE SEQ. |
| UNHOOK AND STORAGE SEQ. 2700 | d | d | d | d | d | d | d | → NOT ENTERED VIA MONITOR MODE SEQ. |
| IN WATER START-UP | 0 | 0 | 0 | d | 1 | d | d | → AUTO START IN WATER START-UP SEQ. 2600 |
| TRAILERING | 0 | 1 | 1 | d | d | d | d | → AUTO START TRAILER SEQ. 2500 IF NOT IN HAUL OUT |
| HAUL OUT | 1 | 1 | 0 | d | d | d | d | → AUTO START HAUL OUT SEQ. 2400 |
| ENGINE START-UP | 0 | 1 | 0 | 0 | 1 | 0 | 1 | → AUTO START ENGINE START-UP SEQ. 2300 |
| WATER LAUNCH | 0 | 1 | 0 | d | 1 | 1 | 1 | → AUTO START IN WATER LAUNCH SEQ. 2200 |
| LAND LAUNCH | 0 | 1 | 1 | d | d | 1 | 1 | → AUTO START LAND LAUNCH SEQ. 2100 |

FIG. 14

SPEED, ACCELERATION, AND TRIM CONTROL SYSTEM FOR POWER BOATS

BACKGROUND OF THE INVENTION

1. Field of the Invention

The present invention concerns automated computerized control systems for the speed, acceleration, and/or trim control of power boats, typically small pleasure boats.

The present invention further concerns computerized electronic safety systems for interacting with a human boat operator for sequencing activities during trailering, hauling out, launching, starting, and like events during the deployment, use, and recovery of small power watercraft.

The present invention further concerns an economical inclinometer/accelerometer that is interrogatable by electrical means including digital computers, and suitable for incorporation in a boat's electrical system, particularly the electrical system of a small power boat.

2.0 Requirements for Speed Control in Operation of Power Boats

A speed, or cruise control is equally as useful during cruising over distances in a power boat as it is useful in driving over distances in an automobile. It may be more useful because power boats are, in some waterways, less prone to encounter circumstances which require variation from a preset speed than are automobiles traveling upon roadways.

An additional requirement for speed control of power boats arises upon the use of such boats for water skiing. Water skiers generally have individually preferred speeds for skiing. If the skier is to be comfortable, these speeds must be controlled within a narrow range, typically within ±0.5 miles per hour. Additionally, water skiers participating in competition water skiing, especially slalom water skiing, must generally run a ski course at an identical predetermined speed, as is dictated by the rules of the sport. There is a corresponding requirement that the speed of the power boat pulling a water skier should be controllable at high precision and repeatability.

2.1 Requirements for Power Boat Acceleration Control

Control of the acceleration of a power boat is important during the use of such boat for pulling water skiers. The pulling of a water skier from an in-water position to a skiing position requires the skier to position himself/herself in the water with ski tips upwards and tilted forward at an approximate 30–45' angle, arms outstretched forwards, and ski rope taut. When ready, the water skier signals the power boat driver to start. The driver normally must apply considerable throttle, often full throttle, to pull the skier from the water and up to the desired water skiing speed. However, for heavy body weight skiers, or skiers behind boats having powerful engines and fast accelerations, a full throttle acceleration may produce far too much force for the skier to be able to hold on to the tow rope and begin water skiing. There is even a risk that high initial acceleration can cause physical harm to the arms and shoulder joints of the skier. Operators of powerful ski boats typically attempt to solve this problem by controlling how fast they move the throttle forward during the course of initiating water skiing.

This is generally an imperfect solution, especially by amateur boat drivers who are unskilled or unpracticed at towing water skiers. Irregular and inconsistent acceleration of the boat magnifies false starts by the water skier and generally detracts from the pleasure of water skiing. Inconsistent acceleration of the boat also makes it more difficult for beginning water skiers to learn how to be pulled from the water to the water skiing position.

There correspondingly exists a requirement for controlling the acceleration of a power boat, particularly as used for pulling water skiers.

2.2 Requirements for Power Boat Trim Control

Trim is the adjustment of a power boat's propulsion system, commonly a propeller, so that it runs at the most efficient angle with respect to the surface of the water even though the hull of the boat may assume different angles relative to such water surface. For example, a power boat may be planing on the surface of the water at an appreciable angle to the surface.

A control of power boat trim that maintains the force generated by the boat's propulsion to be perpendicular to the surface of the water is optimal for (i) maximizing the forward thrust provided to the boat in the water, (ii) increasing the speed with which the boat will operate at a given throttle setting, and (iii) improving fuel economy. Trim control is also useful in a small power boat during the pulling of water skiers. Proper trim adjustment promotes smooth transitions of the power boat between its operational ranges. Skiing behind a power boat that puts out a regular, and regularly progressive, wake due to trim control is especially beneficial when such wake is used by water skiers to facilitate the performance of acrobatics, such as jumps.

Finally, a power boat that is controlled in trim exhibits handling and ride comfort that is strongly preferred by some owners. Severe hull angles are readily induced in small outboard boats under high acceleration, often by youthful operators. Mature power boat owner/operators commonly prefer a smoother ride. Additionally, some power boats are operated in high sea states. Trim control promotes a smooth ride and/or reduction of boat motion due to sea state condition.

2.3.1 Previous Manual and Automatic Trim Control Systems

Manual and automatic trim control for marine drives such as outboards and stern drives are known in the art. A hydraulic cylinder arrangement is disclosed in U.S. Pat. No. 3,434,449 to I. W. North. The cylinder is used to trim a drive unit during operation of a power boat, and additionally to tilt the drive unit for beaching or trailering of the boat. The control of the trim is accomplished through manually operated switches in order to move the drive to the desired trim position.

Because of the limitations of such a manual trim control system wherein the operator must be attentive in order to maintain a proper boat attitude under varied boat loading and speed conditions, automated trim control systems were developed U.S. Pat. No. 4,318,699 to Wenstadt et al., shows a marine trim control system that senses an off-plane and an on-plane condition of a power boat. Responsively to this sensing the trim control system automatically positions a trimmable drive for desired boating operation. The control may alternatively position the drive at one or more trim positions in response to one or more sensed operating speeds. For example, the trim position may be set in response to sensed fluid pressure opposing the movement of the power boat, or alternatively, in response to the sensed engine speed.

It is not completely satisfactory to control the trim of a power boat in response to either its planing condition, its engine speed, or its speed through the water. Effectively, both planing and engine speed and hull speed indications all represent secondary information concerning the attitude that the boat's propulsion system has probably assumed. The trim control system is calibrated for a particular boat, for a particular loading and load distribution of this boat, for a particular sea state and for a particular trim control system.

Unfortunately, in the real world the variables associated with power boat propulsion do not remain constant. The inclination of a boat hull and the optimal trim of the boat's propulsion at any particular engine speed may be a function of the hull shape and cleanliness. The inclination of a boat hull and the trim of the boat's propulsion at any particular hull speed may be a function of the boat's load and load distribution. The trim control of the propulsion system itself may exhibit differing trim angle responses to the same control inputs (drive signals) dependent upon seas state, wear, temperature and other factors.

Even if all variables remain as they were during calibration of an individual system, knowledge of engine or hull speed does not necessarily permit extrapolation of the probable current uncompensated trim angle, and application of the appropriate trim angle correction that is calculated to return trim angle to optimal. It has been found by actual observation of the inventor that, depending upon the position of the people and cargo in a power boat, the angle of the boat in the water at rest can vary between 0 and 8 degrees. In one particular boat, it was found that the inclination angle with only two people in the boat was +4 degrees off the horizon. This angle means that the boat floor is oriented relative to level with the bow up at a 4 degree angle. If most of the weight of passengers were moved to the front of the boat, it was possible with this particular boat to get the inclination angle down to 0 degrees. With most of the weight in the back the inclination angle would come up to +8 degrees.

When the same particular small boat was accelerated, the angle the boat took with the water varied from +15 to +25 degrees. The particular boat started out fairly level and went through a steep inclination angle as it approached the planing condition. When the boat reached a plane, its nose dropped down and it assumed an inclination angle approximately +1 or +2 degrees greater than the rest position. From loading the boat differently along the bow to stern axis it was found that the inclination angle on plane varied from about +2 to +8 degrees. During the time that the boat is coming up on plane, it is clearly accelerating. After it gets on plane it assumes an angle very close to the angle that it was at when it was at rest. In fact, depending upon load conditions in the boat, the two angles were determined to overlap each other. Accordingly, there is no window allowing one to clearly differentiate between the at rest position and on plane condition. The present invention will be found to offer a way around this difficulty.

Recalling that the primary goal of trim control is to optimally position the boat's propulsion relative to the surface of the water, the physical variable which would logically be sensed in order to control trim of a power boat would be the inclination of the boat's hull. Possibly the reason that inclination has not been sensed in prior power boat trim control systems is that inclinometers feasible of incorporation into such systems are generally expensive, unreliable, and difficult to maintain in the high vibration and corrosive marine environment of a small power boat.

2.4 Prior Accelerometers and Inclinometers

The existing art regarding inclinometer and accelerometers is of importance relative to one aspect of the present invention. One previous inclinometer and accelerometer is the pendulous inclinometer/accelerometer. In this device a pendulous mass is suspended to pivot in one or more axes of freedom. The motion of the pendulous mass is subject to the gravitational forces as well as to the acceleration forces. Consequently, a pendulous inclinometer/accelerometer serves to sense both inclination and acceleration, and will sense a net force which is the vector combination of both the inclination and acceleration forces.

The motion of the pendulum of a pendulous inclinometer/accelerometer may be detected and may be used to generate a display that is indicative of inclination and acceleration. Normally the motion detection transpires along each of a plurality of orthogonal axes.

In pendulous inclinometers/accelerometers exhibiting quick and accurate response, it is of considerable importance that the pendulous mass should experience low friction to its movement. One prior electrical scheme for detecting the position of the pendulous mass with minimal restriction or friction upon its motional freedom is to emit a light beam radially from the end of the pendulous mass. This light beam travels through space and intercepts a spatially extended array of light detectors disposed oppositely to the light-emitting end of the pendulum. The position of the pendulum can thereby be determined with no mechanical resistance.

These and other prior schemes for electrically interrogatable inclinometers/accelerometers generally make these instruments both expensive and delicate. Conversely, it is known that a simple fluid-filled arculate tube can serve as an indication of inclination or acceleration. Such tubes are commonly used aboard major nautical vessels to provide a visual indication to the operators of the vessel as to whether the vessel is being operated at attitudes that are within its prescribed design limits. The visually indicating inclinometer/accelerometer displaying colored fluid within a transparent tube does not, however, commonly offer an electrical interface.

Accordingly, it would be useful if an economical, ruggedized, low maintenance, inclinometer/accelerometer that is directly incorporatable within, and interrogatable by, an electrical control system could be constructed.

2.5 Requirements for a Power Boat Safety and Operational Status Surveillance System Operation of a power boat, especially a small pleasure craft used primarily for recreation, is both deceivingly easy and unforgiving of mistakes.

The trailering, launching from a land trailer into water, and recovery sequences of a trailerable power boat are each quite complex. Many lines and straps must be selectively attached and unattached, boat engine operation and trim angle must be controlled, and the boat's bilge must be sealed while within the water but vented on land.

During operation the trim should be monitored to be appropriate (especially when starting in shallow water), and the engine compartment should not be permitted to accumulate explosive vapors.

On a large ship specialists and special systems in propulsion, cargo distribution, line handling and/or safety monitor the ship's function. For small power boats the operation, and safety of the boat is left to the skill and memory of the operator and his/her generally small crew. Because of the often amateur status of these operators and/or crew, their inattentiveness or forgetfulness, or their ignorance the more complex sequences of small boat handling may become a comedy of errors. It is a rare marina where the boat launch ramps are not scarred with props dragged against the ramp surface during recovery of trailerable power craft with improper adjustment of the craft's trim, or where operators have not scrambled to replace a bilge plug in a boat just launched with its bilge unsealed to the water. Many less major errors likewise detract from the enjoyment, economy, safety and professionalism of power boating.

It would correspondingly be desirable if some nature of a man-machine system could facilitate correct power boat operation and safety, especially by parties that exhibit poor skills in these areas.

SUMMARY OF THE INVENTION

The present invention contemplates a computer-based control system for power boats, particularly for, but not limited to small pleasure boats. In accordance with the invention (i) speed control, (ii) speed and acceleration control, and/or (iii) trim control can be economically and reliably implemented. Particularly in the implementation of trim control, a low cost inclinometer/accelerometer of special construction permits the sensing of boat inclination and the control of power boat trim responsive to this sensed inclination.

The present invention still further contemplates that an electronic system, typically the same computer-based electronic system otherwise used for speed, acceleration and/or trim control, serves as a power boat safety system. The safety system is interactive with a human operator for the sequencing and control of certain common activities during the launch, use, and recovery of power boats. The electronic safety system senses conditions. Responsive to the sensed conditions it provides appropriate operator messages or alarms. For example, the system senses conditions and provides both messages and alarms during the hauling out of a trailered power boat from the water onto its land trailer and/or the launching of the power boat into the water from the same trailer. The system ensures that the boat and its trailer are both correctly configured for trailering. Similarly, the electronic safety system supports processes of hauling the boat out of the water onto its trailer, hoisting of the boat onto a hoist, in-water startup of the boat, launching of the boat from its trailer while both the boat and the trailer are in water, starting or restarting the boat's engine, and test or maintenance of the boat on land.

In aggregate, the present invention contemplates comprehensive control and automation of the operational and support procedures attendant upon use of a power boat. The automation accords improved performance, economy and safety during operation of the boat.

1. Control of Power Boat Speed and/or Speed and Acceleration/Deceleration

In accordance with the present invention, a speed control system for a power boat includes a speedometer producing information on the actual speed of the boat. A manual data entry device is used to set information on the desired speed of the boat. A computer processor receives the actual and desired speed information and produces speed error information that indicates both the direction and the magnitude by which the actual power boat speed differs from the desired, manually set power boat speed. This speed error information is used to control the power boat propulsion source so as to make the actual speed more nearly equal to the desired speed. Typically this is accomplished by a servomotor. The servomotor acts to position the throttle of the boat either directly at the engine of the boat, or at a remote site of the boat's manual throttle.

The speed control system is further expandable in accordance with the present invention in order to control the acceleration/deceleration of the power boat. The actual present acceleration of the boat may be derived either from the changes in speed over time or, preferably, directly from an inclinometer/accelerometer. In the case of the expanded system for control of acceleration/deceleration the data entry device is further manually entered with information regarding the desired level(s) of acceleration/deceleration of the boat. The computer processor considers the present and present desired accelerations during its computation of the speed error control signal. This signal, as received by the boat's propulsion, controls the acceleration/deceleration that the power boat undergoes while accelerating/decelerating to its desired speed. The computer processor changes the speed control error signal so as to make the actual acceleration/deceleration of the power boat approximate the desired acceleration/deceleration while the power boat accelerates/decelerates to the desired speed.

2. Control of Power Boat Trim

Control of power boat trim is, in accordance with the present invention, in response to the sensing of the boat's inclination and acceleration in an inclinometer/accelerometer. The translation of the sensed inclination/acceleration into trim control transpires within a microprocessor, and can accordingly be very sophisticated. It need not be, however, and trim control providing a noticeably smoother boat ride is typically obtained by a straightforward scheme of control.

Typically, if the sensed inclination/acceleration angle is between 0 and +10 degrees, then the system matches the trim sender angle to the inclinometer/accelerometer sensed angle so that the outdrive of the boat is always vertical in the water. This may require a constant offset dependent upon the hull location of the inclinometer/accelerometer versus the outdrive. If the sensed angle is greater than +10 degrees, it indicates that the boat is not yet on plane, but is accelerating and approaching the on-plane condition. In this case the sensed angle is used to move the outdrive to the full down position, typically in some boats to the −4 degree position. As soon as the boat begins to go off-plane, the angle that the boat assumes with reference to the water is again a steep angle, typically greater than +10 degrees. When the boat is decelerating, the inclinometer will sense this condition. The sensed information is then used to trim the outdrive to its full down or −4 degree position. If the ignition is determined to be off (by another sensor), or the speed is sensed to be essentially zero (by still another sensor), then that is again an indication that the outdrive should be moved to the full down or −4 degree position.

When the boat reaches the on-plane condition, trim control makes the resistance of the boat to the water much less; helping the boat to skim across the surface of the water. As a result of trim control in accordance with the present invention, a typical power boat will increase in speed on plane by about 10% at a given throttle setting.

This increase in speed is easily detected by both experienced and inexperienced water skiers. It may accordingly be necessary for the operator of the boat to throttle back in order to get the water skier to the speed at which he desires to ski. In tieing together the cruise control and the trim control aspects of the present invention, the servo system sensing the boat's speed can automatically trim back the throttle. Accordingly, the operator no longer has to be concerned about bringing the speed back to within the range desired by the skier. The operator is permitted to concentrate on other more important factors around him such as other boats, skiers or obstacles in the water. By use of the complete system of the present invention a boat operator doesn't have to constantly look back and forth between the speedometer and the water in front of him. This automation both improves water safety and makes the job of driving the boat more pleasurable.

3. An Electrically Interrogatable Inclinometer/Accelerometer

An inclinometer/accelerometer in accordance with the present invention is based on an electrically conductive fluid, typically mercury, that flows within a flow path, typically an arc, of a conduit, typically a tube. The fluid assumes different positions in its flow path under differing gravitational and acceleration forces to which the fluid and the conduit are subjected. A multiplicity of electrical connections are made to the fluid within the conduit at a like multiplicity of electrically conductive elements, typically pins, that are positionally arrayed along the fluid flow path within the conduit. The presence, or absence, of the fluid between any selected ones of the arrayed multiplicity of electrically conductive elements is determined by sensing whether these elements are electrically connected by a presence of the electrically conductive fluid at a corresponding position within its flow path. Because the positions that the electrically conductive fluid assumes within the flow path are dependent upon the gravitational forces due to inclination, and also upon the acceleration forces due to acceleration, to which the fluid is subject, the electrical sensing of its position provides the function of an inclinometer/accelerometer.

In one embodiment of the inclinometer/accelerometer in accordance with the present invention, electrical sensing at ones of the arrayed multiplicity of electrically conductive elements may be made by directly reading the binary voltage levels upon these elements as input data lines to a microprocessor. In other, preferred embodiments the multiplicity of electrical conductive elements connect to a distributed resistance. This distributed resistance may be either (i) a multiplicity of series-connected discrete resistors, (ii) a multiplicity of parallel connected discrete resistors, or (iii) a spatially distended continuous resistive material. Similarly arranged inductors, capacitors, diodes or any element that can divide voltage as a function of mercury position also work to realize the invention.

One preferred embodiment of the distributed resistance is formed from spatially distended continuous resistive material. The material is normally resistive wire, typically nichrome wire. The wire is preferably located entirely within the conduit in position along the flow path of the electrically conductive fluid. In this particular embodiment electrical connection is thusly made to the electrically conductive fluid at an infinite multiplicity of electrically conductive elements.

The conductive fluid can also be fluidically damped by placing another insulating fluid in the tube with the mercury. Examples are any of the commonly available organic solvents. High boiling ones are preferred. The insulating fluid must be a non-solvent for the tubing: Diacetone alcohol, VMC Naptha, Perchlor-ethylene, or silicone oils are preferred. Glass beads may also damp the movement.

No matter what the embodiment of the distributed resistance or other arrayed element exhibiting electromagnetic properties, or whether such element is placed inside or outside the conduit, the sensing of the varying magnitude of the resistance or other electromagnetic characteristic of the element as its various portions are short circuited by the electrically conductive fluid serves to provide an electrical indication of the particular corresponding position of the fluid within its flow path. This position is due to inclination and acceleration, and accordingly the electrical indication is a combination of inclination and acceleration.

4. An Electronic Safety System for a Power Boat

In accordance with the present invention, an electronic safety system for a power boat, and for the trailer(s) and hoist(s) of such boat, is constructed using (i) sensors, (ii) switches or other devices permitting manual selections, and (iii) an alarm/display system that typically includes a computer processor and a display.

In one embodiment of the electronic safety system particularly for checking the process of hauling of a trailerable power boat from the water onto its land trailer, a first sensor checks the running condition of the boat's engine and/or a second sensor checks the trim of the boat's variable trim propulsion drive. A manual switch selection informs the computer processor of the alarm/display system of the impending haul out of the boat from the water onto its land trailer. During the duration of this impending haul out condition, the computer processor validates that the engine is not running and/or that the outdrive is trimmed to the proper position for haul out. If conditions are not proper, hazarding damage to the outdrive, then an alarm, typically a display message, is generated.

In another embodiment of the electronics safety system for checking the process of launching of a trailerable power boat from its land trailer into the water, a sensor senses the detachment of the trailerable boat from its trailer, particularly by the unfastening of the stern straps. Responsively to detachment of the stern straps, the system automatically closes the bilge valve. A manual switch actuation may alternatively inform the computer processor of the impending launching of the trailerable boat. The computer, receiving the sensor and switch inputs generates an alarm upon the occurrence of an unsatisfactory configuration of the boat and/or its trailer for the launching of the boat.

Similarly, other embodiments of the electronic safety system use numerous additional sensors. The computer-based electronic safety system evaluates the inputs of such sensors during various operations associated with the power boat, and provides useful messages and alarms to the boat operator.

BRIEF DESCRIPTION OF THE DRAWINGS

These and other aspects and attributes of the present invention will become increasingly clear upon reference to the drawings and accompanying specification wherein:

FIG. 14 is a table showing the branching to the various microcoded routines that is performed by the microprocessor in response to sensor indications within the electronic safety system in accordance with the present invention;

DESCRIPTION OF THE PREFERRED EMBODIMENT

1. Automatic Speed, Acceleration and/or Trim Control System for a Power Boat

Figure 1A:
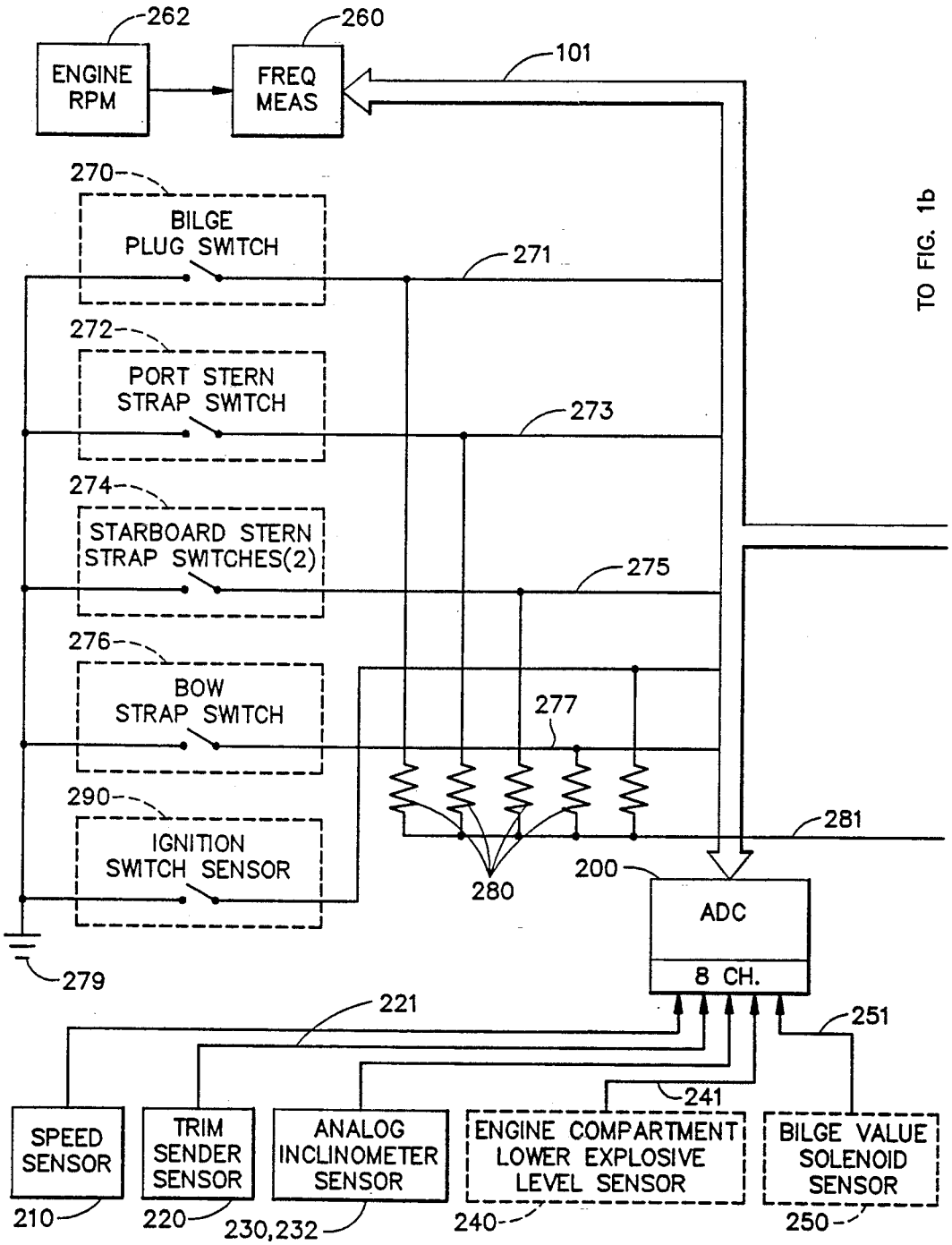
FIG. 1 is a schematic block diagram showing the power boat speed, acceleration, and trim control system of the present invention, which system is optionally expandable to additionally serve as an electronic safety system.

In one of its aspects, the present invention concerns the automatic control of speed, speed and acceleration, and/or trim for a power boat. The boat is typically, but not necessarily, a small pleasure craft. A block diagram of a system so performing such control is shown in FIG. 1. The elements that are necessary to the control of speed, acceleration, and/or trim are shown in solid line. Additional elements which may be used in an expansion and adaptation of the system for the purposes of safety and/or operator guidance are shown in dashed line.

The automated control of speed, acceleration, and trim control system 10 is enabled in microprocessor uP 100. Generally in FIG. 1 sensors and other elements which provide input signals to the microprocessor are shown at the left of the figure (although there are exceptions such as keyboard 350). Meanwhile, displays, alarms and driven elements are generally shown at the right of the figure. Most of the elements are commonly available, and will be so identified. Those elements which are of particular, unique construction will be the subject of additional figures.

The ENGINE RPM 262 typically provides a periodic voltage waveform that is derived from the particular engine of the power boat. This waveform is received in frequency measurement circuit FREQ MEAS 260, commonly type COP 452 available from National Semiconductor. The frequency representing the speed of the boat's engine is digitalized and interrogatable on bus 101 by uP 100.

Continuing in FIG. 1, remaining sensor inputs to uP 100 are typically routed through analog to digital converter ADC 200, typically type WP 0838 available from National Semiconductor. A SPEED SENSOR 210, a preferred variant of which will be shown in greater detail in FIG. 2, senses the speed of the boat through the water and transmits an analog signal representative of such speed to the ADC 200. The digitalized conversion of such analog signal, selectably under control of uP 100 provides a data input via bus 101 to uP 100. This input permits the up 100 to know the actual current speed of the boat.

Similarly, a TRIM SENDER SENSOR 220 produces an analog signal that is indicative of the current trim of the boat, which may exhibit a variable trim. An example of such a TRIM SENDER SENSOR 220 is contained in U.S. Pat. No. 4,318,699 to Wenstadt, et al., for TRIM CONTROL, the contents of which patent are incorporated herein by reference. Trim-controlled outdrives normally have a trim sensor in the form of a rotary potentiometer at the gimbal mounting of the outdrive.

The ANALOG INCLINOMETER SENSOR 230, 232 is preferably of special construction. It is preferably one of two embodiments (230 or 232) which will be respectively diagrammatically shown in FIG. 3 and FIG. 5. Conventional pendulous inclinometer/accelerometers having an analog signal output could alternatively be employed.

The uP 100 communicates via its second, nominally its "output", bidirectional communication bus 103 to CRUISE CONTROL SERVO MOTOR DRIVER 300. The digital signal received by this DRIVER 300 is typically converted into an analog signal of high power that is used to drive SERVO MOTOR 302, 304. Each SERVO MOTOR 302, 304 is conventional, and may each be the same type. The SERVO MOTOR is assigned two different identification numbers (302 or 304) dependent upon whether it is deployed proximate to the engine throttle, as will be illustrated in FIG. 6, or, alternatively, proximate to the hand throttle of the boat, as will be illustrated in FIG. 7.

Communication from the uP 100 via bus 103 to the UP TRIM SOLENOID DRIVER 310 is used for control of the "UP" TRIM SOLENOID 312. Likewise, communication to the "DOWN" TRIM SOLENOID DRIVER 320 is used to control the "DOWN" TRIM SOLENOID 322. Control of both solenoids is pertinent to the function of the present invention for trim control. Power trim control is common for outboard and inboard/outboard power boats. One such system for power trim control is taught in the aforementioned U.S. Pat. No. 4,318,699 that is incorporated within this specification by reference. The trim control function of the system of the present invention is readily adaptable to existing TRIM SOLENOID DRIVERs 310, 320 and TRIM SOLENOIDs 312, 322 of diverse types. Signal level and/or polarity shifters and/or digital to analog converters may be employed as required. The microcode executed by uP 100 may be adjusted in accordance with the parameters of any particular power trim control solenoid drivers and solenoids that are controlled by the system of the present invention.

The uP 100 controls the ENGINE COMPARTMENT BLOWER MOTOR DRIVER 330 via bus 103 for purposes of evacuating potentially explosive fumes from the engine compartment of certain types of power boats, typically inboards and stern drives. The control of BLOWER MOTOR 332 may be considered to be part of the optional, enhanced system of the present invention for controlling the safety of a power boat. Normally, however, the venting of fuel vapors, exhaust gases, and the like is so important to safe boating that this function is implemented even within the basic system for speed, acceleration, and/or trim control, and is thusly shown in solid line in FIG. 1.

The operator interface with the program operating within uP 100 is obtained through connection to LCD DISPLAY DRIVER 340 controlling LCD DISPLAY 342 for the generation of output messages, and through connection to KEYBOARD 350 for the receipt of input control. The KEYBOARD 350 may be a simple array of switches, or a single rotary switch in rudimentary applications. It need not be a full computer keyboard, but may typically be a keypad. Similarly, the DISPLAY DRIVER 340 and DISPLAY 342 need not exclusively be based on liquid crystals, but can employ light emitting diodes, electroluminescent panels, or other suitable types of displays. Suitable display drivers and displays are available from Hitachi and National Semiconductor. Preferred keyboards are available from Emco and Texas Instruments.

The microprocessor up 100 interfaces via bidirectional bus 103 to MEMORY 360. The MEMORY 360 is typically semiconductor dynamic random access memory (DRAM), static random access memory (RAM), or read only memory (ROM). The MEMORY 360 may be partitioned into plural types. In particular, electrically erasable read only memory (EEROM) is preferred for storing in a nonvolatile way the operator's previously-entered desired speed and acceleration/deceleration parameters.

Because the speed, acceleration and/or trim control system 10 shown in block diagram in FIG. 1 is substantially based on a microprogrammable uP 100, it is readily susceptible to being expanded so as to incorporate additional functions. Indeed, the uP 100 normally possesses considerable extra computational capacity to perform additional tasks in management of a small power boat. This potential is indicated by the block FUTURE EXPANSION 410 shown in dashed phantom line. A very particular form of an actual such expansion, to be fully taught and explained in this patent application, is represented by those additional blocks that are shown in dashed line in FIG. 1. The elements within these blocks will be further explained in conjunction with the discussion of FIG. 10.

Figure 1B:
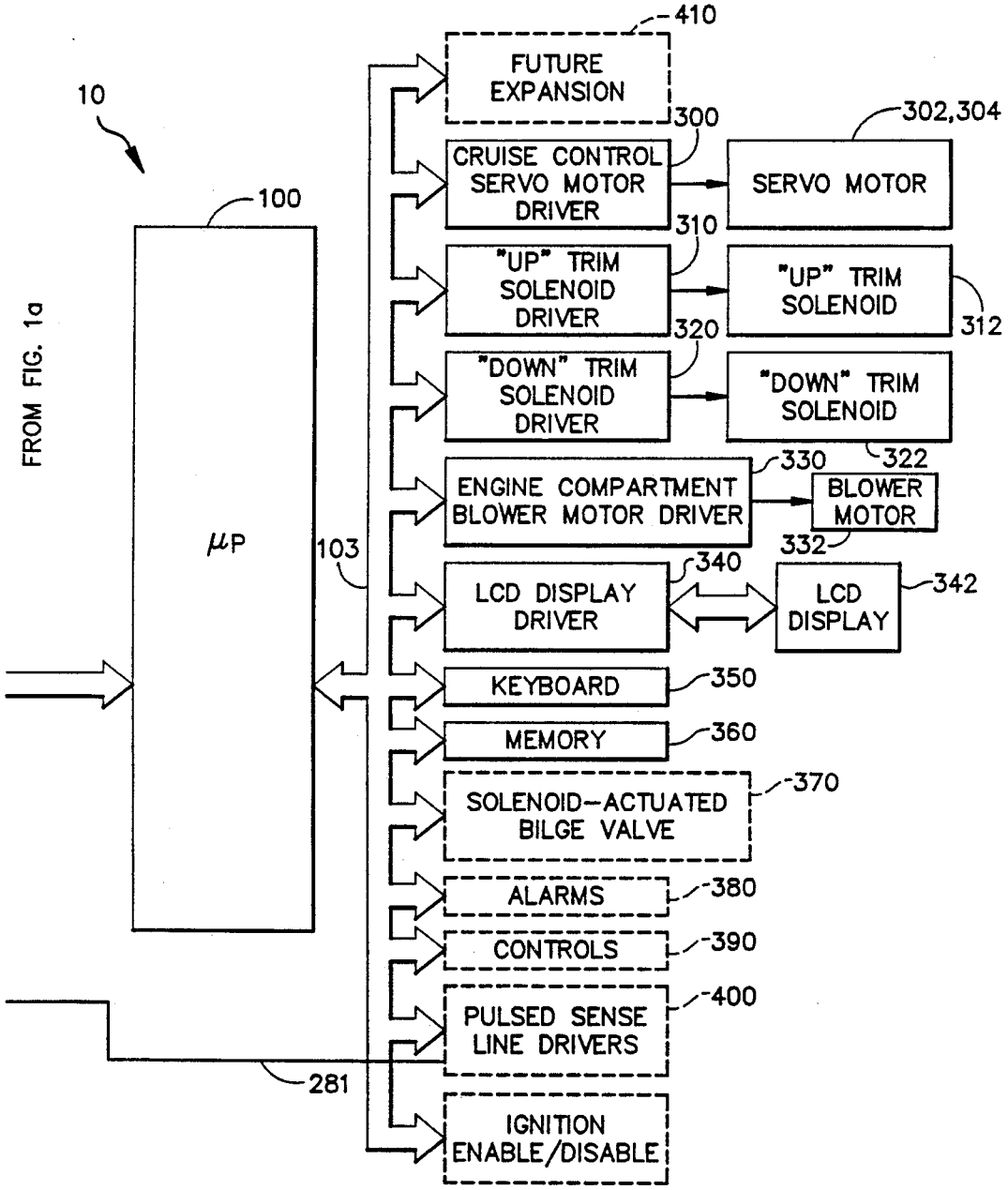
Figure 2:
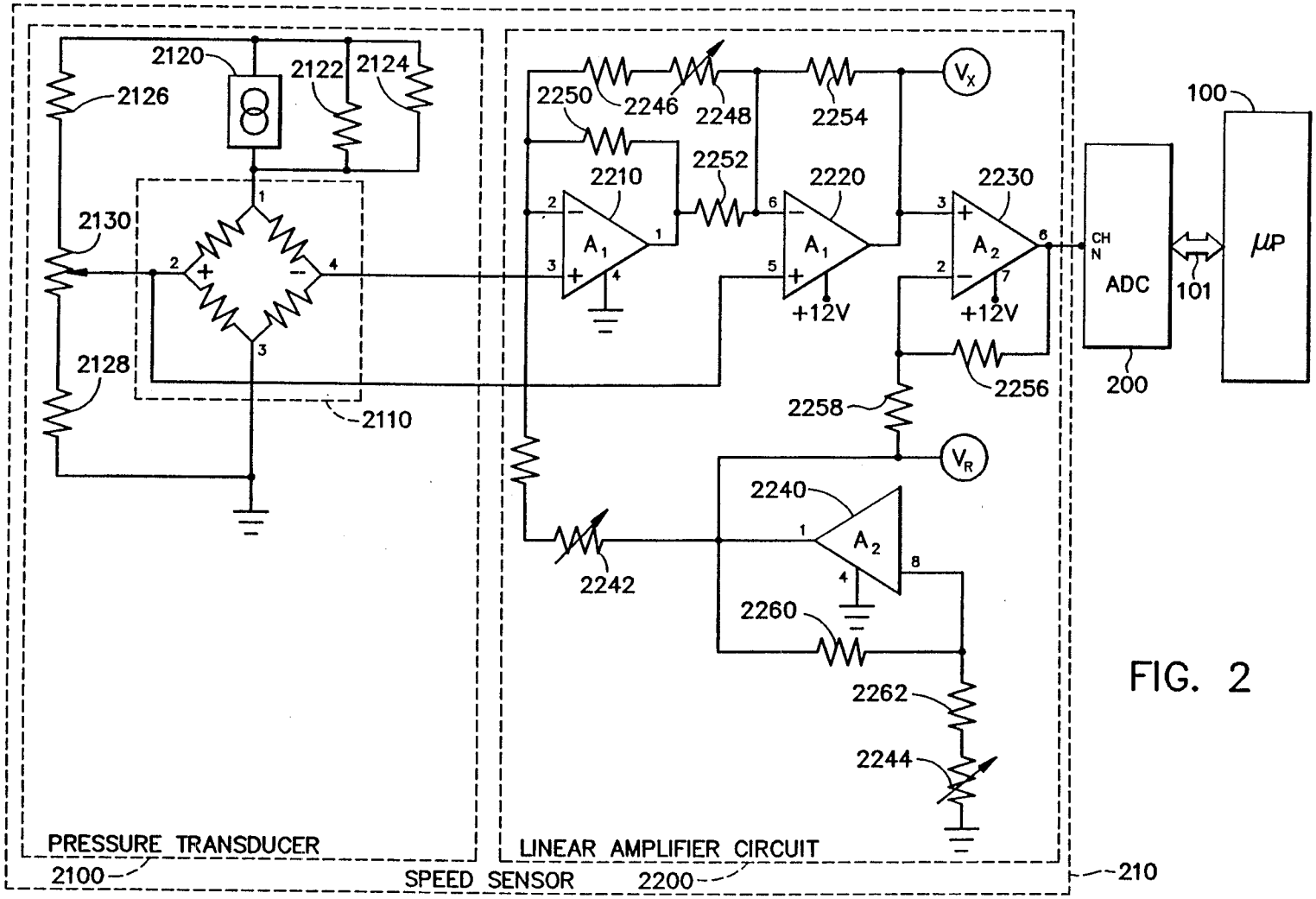
FIG. 2 is a schematic diagram of a speed sensor component, previously seem in FIG. 1 of the power boat speed, acceleration, and trim control system in accordance with the present invention.

The SPEED SENSOR 210, shown in block diagram in FIG. 1, is preferably implemented from a PRESSURE TRANSDUCER 2100 and a LINEAR AMPLIFIER CIRCUIT 2200 which are both shown in schematic diagram in FIG. 2. Other forms of known speed sensors for small power craft that provide an analog, or even a microprocessor-compatible digital, signal output are also suitable for use. The particular circuit shown in FIG. 2 is preferred for being both economical and reliable.

Figure 24:
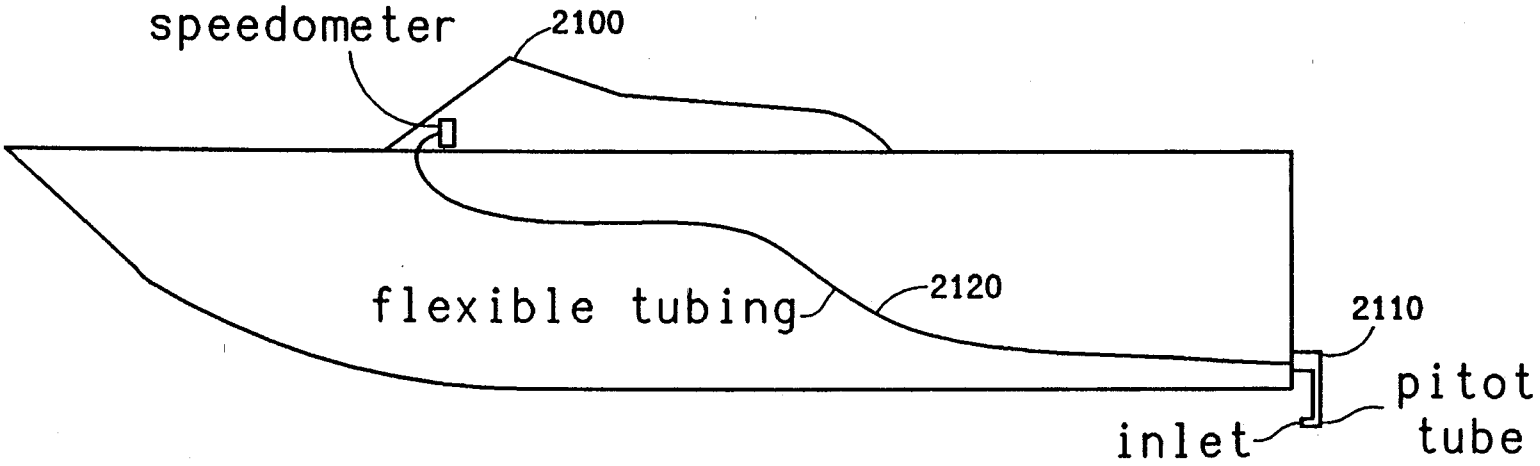
FIG. 24 is a pictorial diagram showing the preferred location of a pitot tube velocity sensor, used in the control system of the present invention, upon the hull of a power boat.

The PRESSURE TRANSDUCER 2100 is a temperature-compensated pressure transducer for speed transduction from a pitot tube speedometer. The PRESSURE TRANSDUCER 2100 is preferably type SX30DN available from Sensym. It senses 0 to 30 pounds per square inch (Psi) pressure transducer when it is positioned at the pressurized section of a pitot tube. The other, operative, section of the pitot tube extends through the hull of the boat and is bent at a right angle upstream into the water flow that is experienced across the boat's hull during the boat's movement. A pictorial diagram showing the preferred positioning, and connection, of a pitot tube 2100 by flexible tubing 2120 to the PRESSURE TRANSDUCER 2100 is shown in FIG. 24. Under the well understood principles of a pitot tube, the use of PRESSURE TRANSDUCER 2110 as a manometer to sense the pressure at the opposite end of the pitot tube gives a measurement of fluid velocity. This fluid velocity is, of course, the velocity of the boat relative to the water. Because, excepting the presence of currents, the water is normally essentially motionless, the sensed motion of the boat relative to the water is normally the boat's velocity on the planet.

Also in the preferred embodiment of PRESSURE TRANSDUCER 2100 is a circuit compensating for the temperature coefficient of the PRESSURE TRANSDUCER 2100. This circuit is based on constant current source 2120 exhibiting a well known temperature coefficient in parallel with 36 ohm resistance 2122 and 7.1K ohm resistance 2124. The current source 2120 is preferably type LM334 available from Linear Technology. A resistive divider consisting of 100K ohm resistances 2126 and 2128 plus a variable 10K ohm resistance 2130 completes the PRESSURE TRANSDUCER 2100.

The differential signal outputs developed in PRESSURE TRANSDUCER 2100 are received into LINEAR AMPLIFIER CIRCUIT 2200 and amplified in a circuit of conventional design. The two amplifiers A1 are preferably dual operational amplifiers type LT1013CN8 available from Linear Technology. The two amplifiers type A2 are preferably dual operational amplifiers type LM10CN8 available from Linear Technology. The indicated variable resistances 2242 and 2244 respectively of nominal values 5K and 1K permit that the analog signal output of linear amplifier circuit 2200 available at Pin 6 of amplifier 2230, may be adjusted to be zero volts at zero speed of the boat through the water. The resistance 2246 is typically 6.6K ohms, the variable resistance 2248 is typically 2K ohms, and each of the resistances 2250–2260 is typically 100K ohms. The resistance 2262 is typically 2.26K ohms. The overall LINEAR AMPLIFIER CIRCUIT 2200 provides an approximate voltage gain of x200.

The analog signal output from speed sensor 210 is received at analog to digital converter ADC 200, and digitalized for communication via bus 101 to uP 100 (both of which elements were previously shown in the block diagram of FIG. 1).

2. An Electrically Connectable Inclinometer/Accelerometer in Accordance with the Present Invention Two embodiments of an inclinometer/accelerometer in accordance with the present invention, each of which is usable as ANALOG INCLINOMETER SENSOR 230, 232 shown in FIG. 1, are shown in FIGS. 3 through 5. The purpose of both embodiments of the inclinometer/accelerometer is to accurately indicate the vector combination in one plane of both the gravitational force due to inclination and the acceleration force due to acceleration. This indication will be both electrical and optionally visible.

Figure 3A:
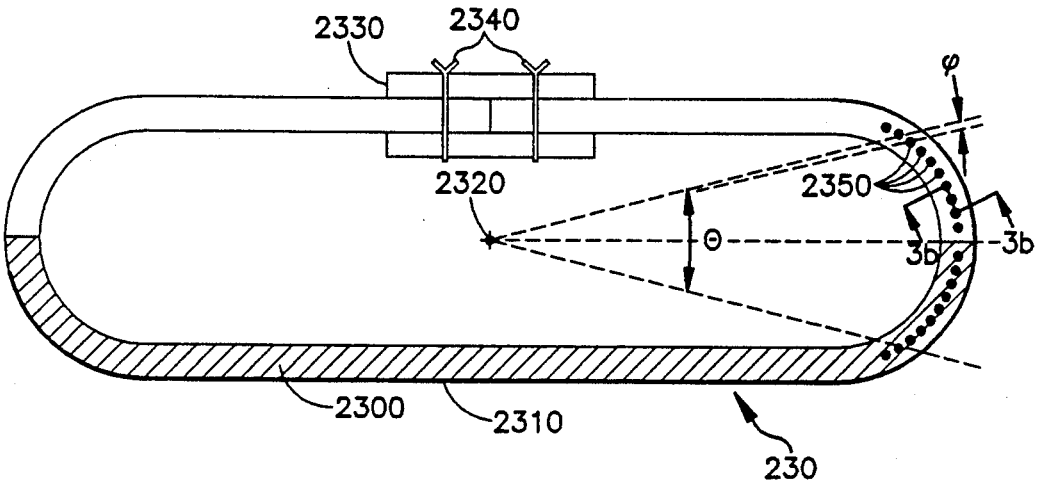
FIG. 3*a* is a side plan view of a first preferred embodiment of an inclinometer/accelerometer in accordance with the present invention that is suitable to serve as the analog inclinometer sensor shown in FIG. 1.
Figure 3B:
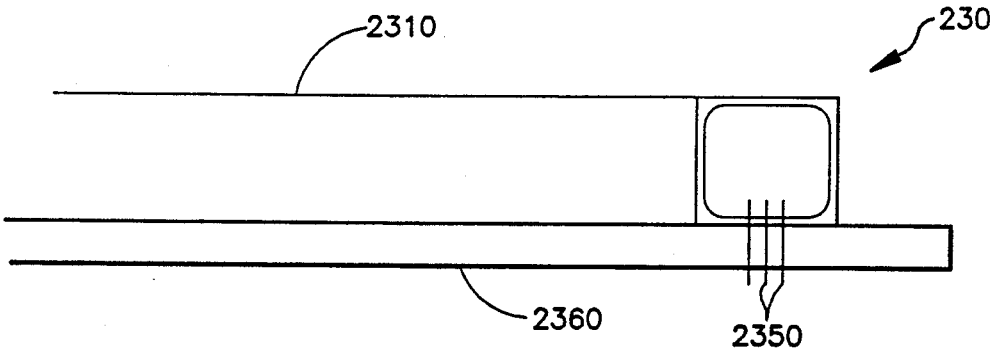
FIG. 3*b* is a plan view, taken along the complex section planes 3*b*—3*b* shown in FIG. 3*a*, showing a cross section of the first embodiment of the inclinometer/accelerometer in accordance with the present invention.

A first embodiment of an inclinometer/accelerometer serving as ANALOG INCLINOMETER SENSOR 230 (previously shown in FIG. 1) is shown in side view in FIG. 3*a*, and in cut away cross-sectional view in FIG. 3*b*. A tube, or conduit, 2310 contains electrically conducting liquid 2300. The tube 2310 is typically polyurethane tubing, and the electrically conducting liquid 2300 is typically mercury. The tube 2310 is joined end to end by tubing coupling 2330 and secured by hose clamp 2340, thus forming a continuous loop. The entire ANALOG INCLINOMETER SENSOR 230 is pivoted about pivot point 2320 through an angle theta.

A number of electrically conductive elements 2350 are arrayed at the interior of the tube 2310 in positions along the flow path traversed by electrically conductive liquid 2300 as the SENSOR 230 pivots about pivot point 2320. The arrayed electrically conductive elements 2350 need not be equidistant from one another nor at equiangular separation relative to pivot point 2320. However, electrically conductive elements 2350 are normally spaced at equal angles relative to pivot point 2320, and are typically at 1° angular separation. The electrically conductive elements 2350 can obviously be spaced at any angular separation appropriate for data acquisition and processing for purposes of control. The total number of the electrically conductive elements 2350 is typically 21, which span an angular range from −10° to +10° about level.

A preferred embodiment of the electrically conductive elements 2350 within the first embodiment inclinometer/accelerometer 230 is shown in cross-section in FIG. 3*b*. The tube 2310 containing liquid 2300 (not shown in the cross-sectional view of FIG. 3*b*) is preferably stably mounted to a substrate, typically a printed circuit board 2360. A number of electrical pins connect through the printed circuit substrate 2360 and into the interior of tube 2310 at positions along the flow path of liquid 2330 (not shown). Before next considering FIG. 4, it may be observed in FIGS. 3*a* and 3*b* that varying individual ones of the electrically conductive elements 2350 will be selectively electrically connected to one another by presence of the electrically conductive fluid 2300 at varying positions in its flow path depending upon the angular orientation of the SENSOR 230.

Figure 4A:
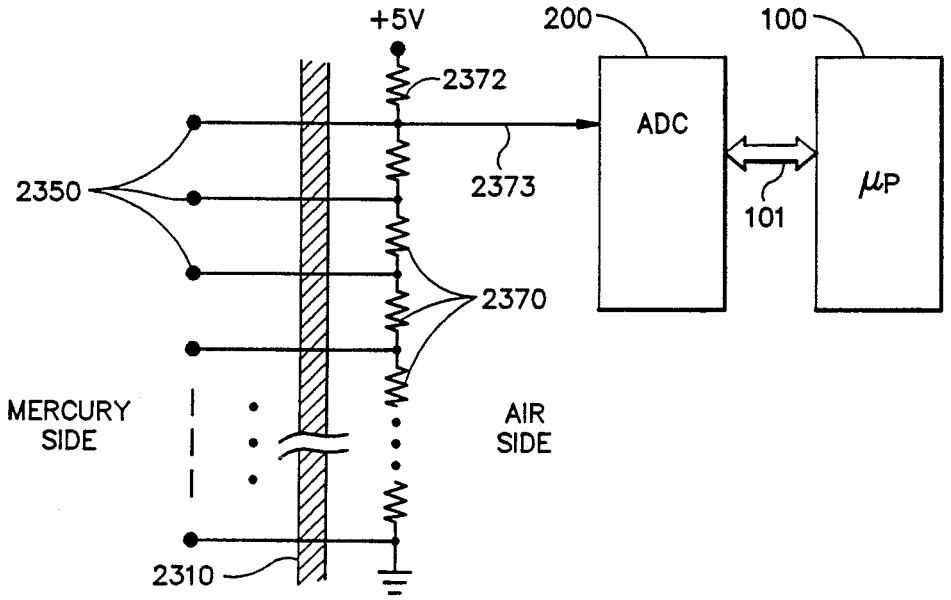
FIG. 4, consisting of FIG. 4*a* through FIG. 4*c*, shows schematic diagrams of various means of electrically connecting to the first embodiment of the inclinometer-/accelerometer shown in FIG. 3.
Figure 4B:
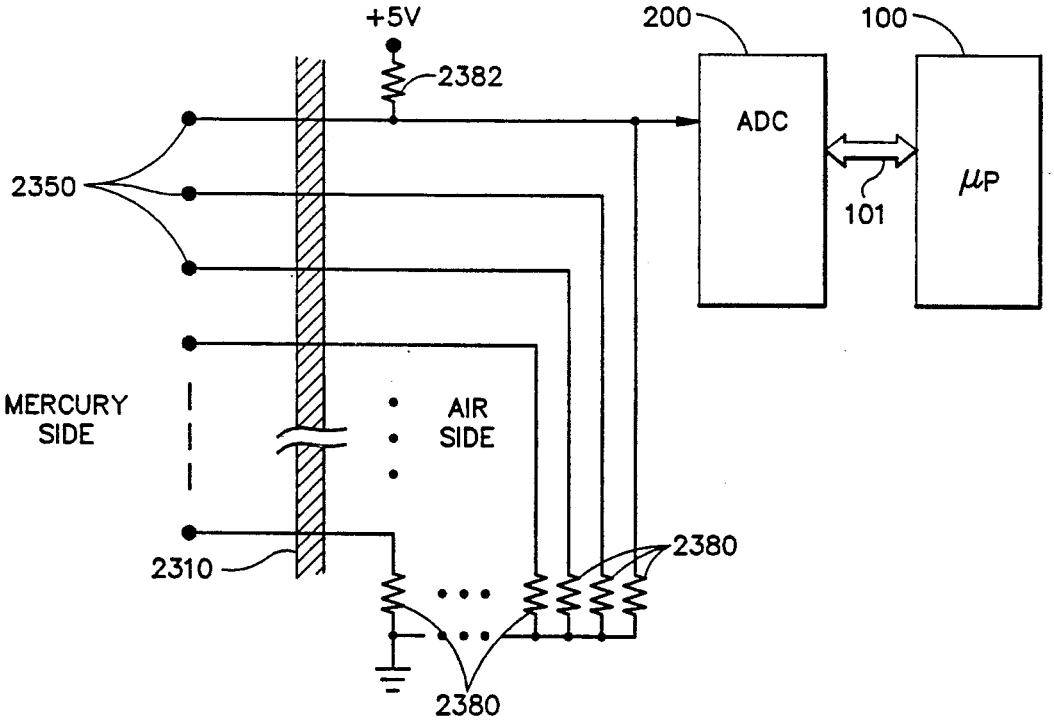
Figure 4C:
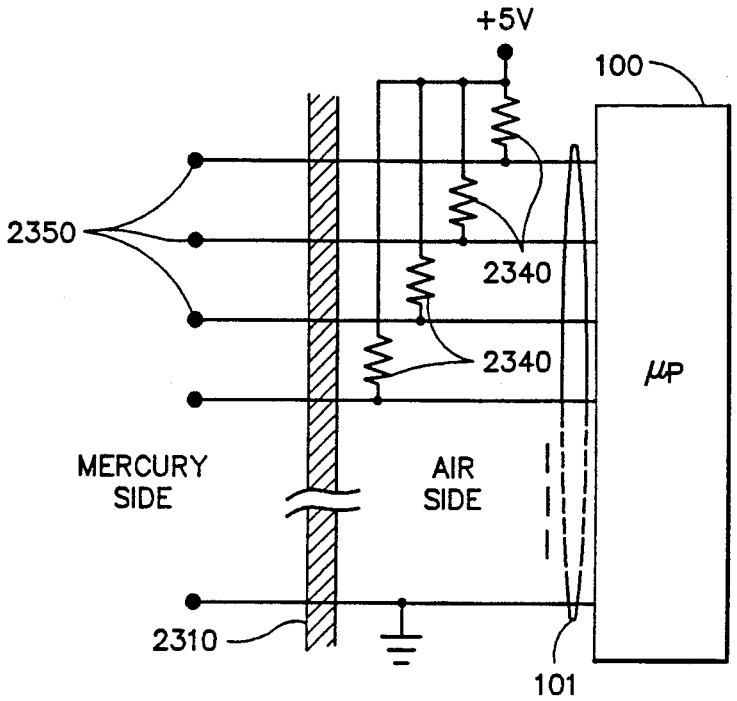
Figure 5:
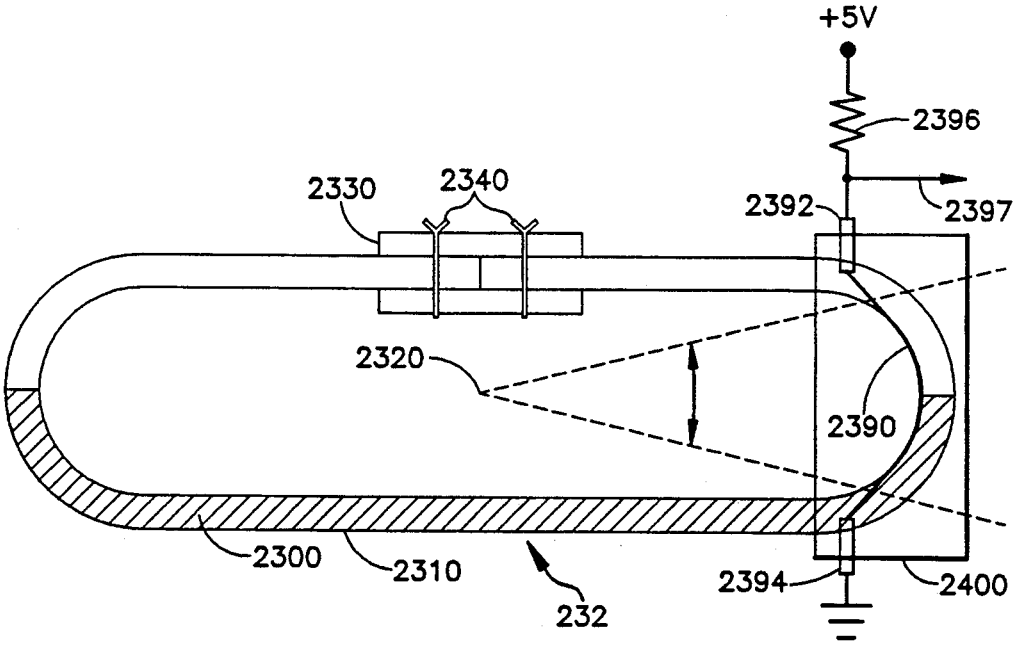
FIG. 5 is a side plan view showing a second embodiment of the inclinometer/accelerometer in accordance with the present invention wherein a distributed resistance is located within a conduit of the inclinometer/accelerometer and in contact with its electrically conductive fluid.

Three alternative embodiments of electrical connection to the electrically conductive elements 2350 of the sensor 230 are shown in FIGS. 4*a*–4*c*. In each case electrically conductive contact is made to the electrically conductive elements 2350, which extend into the "mercury side" of tube 2310, through the wall of tube 2310. The electrically conductive elements 2350 passing through the wall of tube 2310 electrically connect to either the distributed resistance 2370 as shown in FIG. 4*a*, the distributed resistance 2380 as shown in FIG. 4*b*, or directly to bus 101 of microprocessor 100 as shown in FIG. 4*c*.

Considering first the embodiment shown in FIG. 4c, an end conductor, typically located at −10° (reference FIG. 3a) of the electrically conductive elements 2350 is connected to ground. Selective ones of the remainder of the elements 2350 will also be connected to ground dependent upon the position of electrically conductive fluid 2300 within its flow path. The electrically conductive fluid 2300 is presumed to be a good conductor. This causes that selective ones of the elements 2350 will be at approximately 0 volts dc when connected by the electrically conductive fluid 2300 to ground. The lines of bus 101 are biased to a logical high, nominal +5 volt dc, voltage level, by resistors 2340. Only those electrically conductive elements 2350 that are shorted to ground by action of electrically conductive fluid 2300 within its flow path will be at 0 volts dc, or logical low. The remaining elements 2350 will remain +5 volts dc, or logic high. The relative sensing of logic high and low conditions upon the digital input signal lines of bus 101 allows uP 101 to sense the position of electrically conductive fluid 2300 within its flow path within tube 2310, and thus the combinatorial inclination/accelerometer of SENSOR 230. The electrically conductive elements 2350 shown in FIG. 4c may be multiplexed to uP 101. In other words, the number of elements 2350 can be greater than the number of signal lines within bus 101. The embodiment shown in FIG. 4c does, however, require a large number of signal lines between the SENSOR 230 and the electrical components to which it connects, such as a multiplexer (not shown) or directly via bus 101 to uP 101.

A first preferred embodiment of the electrical connections to the first embodiment of the inclinometer/accelerometer is shown in FIG. 4a. The electrically conductive elements 2350 are electrically connected to a distributed resistance in the form of a series-connected array of discrete resistances 2370. A first end one of such array of discrete resistances is connected, typically through an additional resistor 2372, to a source of voltage, normally +5 volts dc. A second end one of such discrete resistances 2370, and a corresponding end one of the electrically conductive elements 2350, is connected to ground. The collective series-arrayed resistances 2370 form a resistive divider with fixed resistance 2372. The voltage at the center point of this resistive divider is sensed by ADC 200 as an indication of the net effective resistance of series-connected array of discrete resistances 2370. The resistance of this array will vary depending upon how many of the associated ones of the electrically conductive elements 2350 are shorted to ground by a presence of the electrically conductive fluid 2300 at a corresponding position within its flow path within tubing 2310. A single signal line 2373 transmitting a single analog dc voltage thus suffices as an indication of the angular displacement of SENSOR 230.

A second preferred embodiment of the electrical connections to the first embodiment of the accelerometer/inclinometer is shown in FIG. 4b. An end one of the electrically conductive elements 2350, typically that element at +10 inclination/acceleration, is connected through resistance 2382 to +5 volts dc. Remaining ones of the electrically conductive elements 2350 each connect through a respective one of a parallel array of discrete resistances 2380 to ground. The fixed resistance 2382 and one or more of the parallel array of resistances 2380 form a resistive divider. The voltage at the mid point of this resistive divider is detected by ADC 200. The number of the discrete resistances 2380 which are within the voltage divider will be a function of the position of electrically conductive fluid 2300 within its flow path within tube 2310. The resistances 2380 are normally in a monotonic sequence of resistive values so that the net voltage change at the junction of the resistive divider is approximately equal for each successive one of the electrically conductive elements 2350 that is successively shorted to the end one, +10°, element.

Consideration of the movement of electrically conductive fluid 2300 across and along the arrayed electrically conductive elements 2350 in each of the connection embodiments shown in FIGS. 4a–4c will reveal many interesting and useful phenomena. The length of the "slug" of electrically conductive fluid 2350, which is normally so long as to span across all of the arrayed electrically conductive elements 2350, will have a pronounced effect on the sensing, especially in the embodiments of FIGS. 4c and 4a. Adjustment of the lineal extent of the electrically conductive fluid 2350 within its flow path can be exploited to advantage. The fluid 2350 need not be accompanied, as is typical, by air within tube 2310, but can be accompanied by another immiscible fluid. Consider the effect on fluid position, and especially that of a short slug, when the first embodiment of the inclinometer/accelerometer shown in FIG. 3a is accelerated left/right transversely—an axis orthogonal to the up/down inclination or acceleration principally sensed. A slug of conductive fluid 2350 can be cased to spread out, or contract, in lineal extent in proportion to acceleration along axis orthogonal to the axis sensed. This is useful in applications such as rockets wherein it is important not only what the rocket's vertical inclination is, but how fast the rocket is accelerating, and thusly able to recover from inclination errors.

Consider that movement of electrically conductive fluid 2300 in the connection embodiment shown in FIG. 4b is normally from a position that would be uppermost in the illustration to progressively lower positions, giving progressive sensing. As soon as the one of the electrically conductive elements 2350 connecting to resistor 2382 is uncovered, or if the fluid 2300 has only recently lapped over this element, large signal changes are experienced. The embodiment of FIG. 4b is a limit-indicating configuration, which exhibits threshold changes at certain inclinations. These threshold changes are useful in triggering alarms (such as a roll-over alarm) and the like.

Finally, it should be considered that the principles of an inclinometer/accelerometer sensor in accordance with the present invention are extrapolatable to simultaneous sensing along more than one axis, such as by conductive fluid moving on the interior surface of a sphere. Alternatively, a "staircase" or "waterfall" channel may be implemented in each of one or more axis. The many different container geometries, fluid quantities, and arrays of electrically conductive elements possible with the present invention recommend an accelerometer/inclinometer constructed in accordance with the invention to those situations where detection of a complex acceleration and/or inclination is desired.

It will further be understood that the electrical connection shown in FIGS. 4a–4c are exemplary only, and that diverse other electrical connections may be made to even the first embodiment of an inclinometer/accelerometer in accordance with the present invention.

The present invention contemplates that the external, and externally detectable, electrical characteristics of an inclinometer/accelerometer may be varied in accordance with the position of an electrically conductive fluid within a flow path established within such inclinometer/accelerometer. Once this principal is recognized, diverse modes of electrical connection to and across inclinometer/accelerometers of diverse geometries are presented.

As a further example of an inclinometer/accelerometer in accordance with the present invention, a second embodiment is shown in FIG. 5. As within the first embodiment, an electrically conductive fluid 2300, typically mercury, moves within a tube, or conduit, 2310, typically polyurethane tubing. The tube 2310 is connected in a closed loop by tubing coupling 2330 that is secured by fasteners, typically hose clamps, 2340. It should be understood that the tube 2310 need not be closed nor oval (or circular), but is conveniently closed so as to prevent contamination or loss of electrically conductive fluid 2300.

Compared to the first embodiment of the accelerometer/inclinometer shown in FIG. 3, the electrically conductive elements 2350 internal to the tube 2310, and in selective electrical contact with the electrically conductive fluid 2300 within its flow path, are replaced by a continuous distributed resistance element 2390. The distributed resistance 2390 is typically wire, and more typically nichrome wire type Stablohn 800 available from California Fine Wire, Inc. The distributed resistance 2390 is in electrical contact at a first terminal 2394 to ground. It is in electrical contact at a second terminal through resistance 2396 to a source of voltage, typically +5 vdc. The distributed resistance 2390 and the fixed resistance 2396 form a voltage divider, the voltage at which is detectable via signal line 2397 at an analog to digital converter ADC 200 (shown in FIG. 1). The entire tube 2310 and its contained distributed resistance 2390 is preferably potted in a solid assembly 2400 so that only terminals 2392, 2394 are exposed. These externally exposed terminals 2392, 2394 are preferably copper, gold, or nickel.

The inclination of ANALOG INCLINOMETER SENSOR 232 about pivot point 2320 induces the electrically conductive fluid 2300 to extend over various portions of the distributed resistance 2390. The portion of such resistance that is contacted by the electrically conductive fluid within its path is effectively short circuited, the resistance of the fluid 2300 per lineal or angular displacement being considerably different than the resistance of the distributed resistance 2390 over the same lineal or angular displacement. The net resistance between terminals 2392 and 2394, and the voltage sensed on signal line 2397, is thus indicative of the inclination/acceleration experienced by ANALOG INCLINOMETER SENSOR 232.

The SENSOR 232 shown in FIG. 5 is extremely resistant to shock and vibration. If desired, the entire channel can be formed within hard steel suitably treated in its interior surface so as to be nonconducting or poorly conducting. When compression, as opposed to movement, of the electrically conductive fluid is relied upon as an indication of acceleration, then an encased embodiment of the inclinometer/accelerometer in accordance with the present invention may be incorporated in the heads of artillery shells or other environments for measurement of accelerations on the order of 50–100 g.

The two embodiments 230, 232, of an inclinometer/accelerometer sensor in accordance with the present invention will both be recognized to be alternative expressions of the same concept. The electrically conductive elements 2350 within the first embodiment shown in FIG. 3 can be considered to have become infinite in number, and the sensitivity of the inclinometer/accelerometer to angular change to have correspondingly become infinitely sensitive, in the second embodiment shown in FIG. 5.

It should also be understood that the orientation, aspect ratio, shape, or other factors of the flow path of the electrically conductive fluid need not be identically as shown in FIGS. 3, 5. Indeed, the electrically conductive fluid could be maintained within a hemisphere. A number of electrical connections made to the electrically conductive fluid internal to such hemisphere could indicate its displacement under forces of gravity and/or acceleration. A number of distributed resistances similar to nichrome wire 2390 (shown in FIG. 5) could be formed into a star burst, or grid, on such a hemispherical surface. It should thusly be understood that the inclinometer/accelerometer in accordance with the present invention may, in still further embodiments, be used to sense inclination and/or acceleration in a plurality of axes at the same time to produce a single composite, signal output. Such a plural axis inclinometer/accelerometer is a three dimensional sensor.

It should further be understood that the signal(s) that is (are) applied across the varying resistance(s) within the accelerometers/inclinometers in accordance with the present invention need not have been direct current, but could have, alternatively, been an alternating current wave form. Particularly in the case of a spherical sensor combinatorially sensing acceleration and inclination on a plurality of axes at the same time, the signals that are applied could be alternating current waveforms that differ in phase. For example, distributed resistances that lie along orthogonal sensor axes could be supplied with alternating current waveforms that exhibit a 90° phase difference. The output signals from the sensors could be combined, such as in a differential amplifier. The composite signal would be indicative of the inclination/acceleration of the device in each of two mutually orthogonal axes.

In accordance with these and other possible variants, the inclinometer/accelerometer in accordance with the present invention will be understood to present an economic, reliable, ruggedized, and accurate means of electrically sensing inclination and/or acceleration. This invention is not limited to those two embodiments within which the invention has been taught. Rather, the invention is properly limited only by those claims hereinafter contained.

3. Use of Servo Motors or Pneumatic Actuators for Engine Throttle Control

An electronic linkage for the control of the propulsive power of a small power boat is uncommon. Generally such propulsion units of such boats are based on one or more engines, and the control of the power output of such engines is effected by mechanical adjustment of an engine throttle. Two alternative embodiments of a control system using a servo motor 302, 304 (shown in FIG. 1) for the control of an engine throttle are shown in FIGS. 6 and 7. Pneumatic actuators (not shown) may alternatively be used in lieu of servo motors. Both the servo motors and the pneumatic actuators are generically sources of motive power.

Figure 6A:
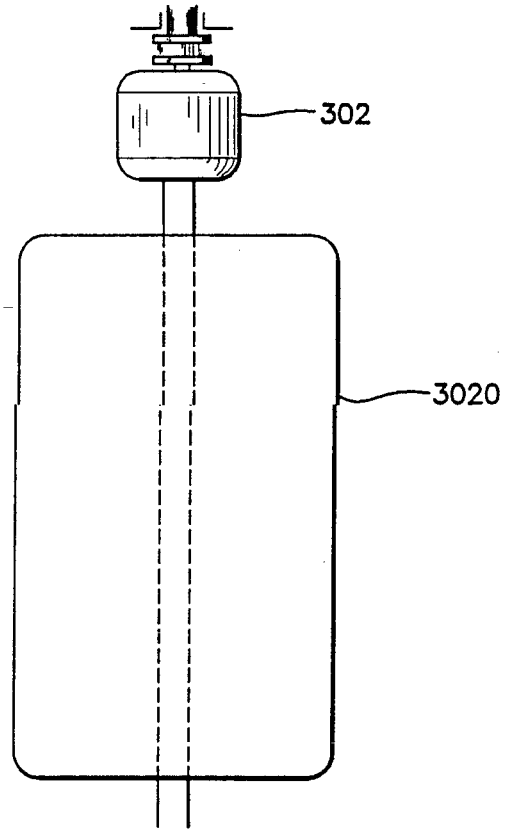
FIG. 6*a* is a top plan view diagrammatically showing a first embodiment of the servomotor previously seen in FIG. 1.
Figure 6B:
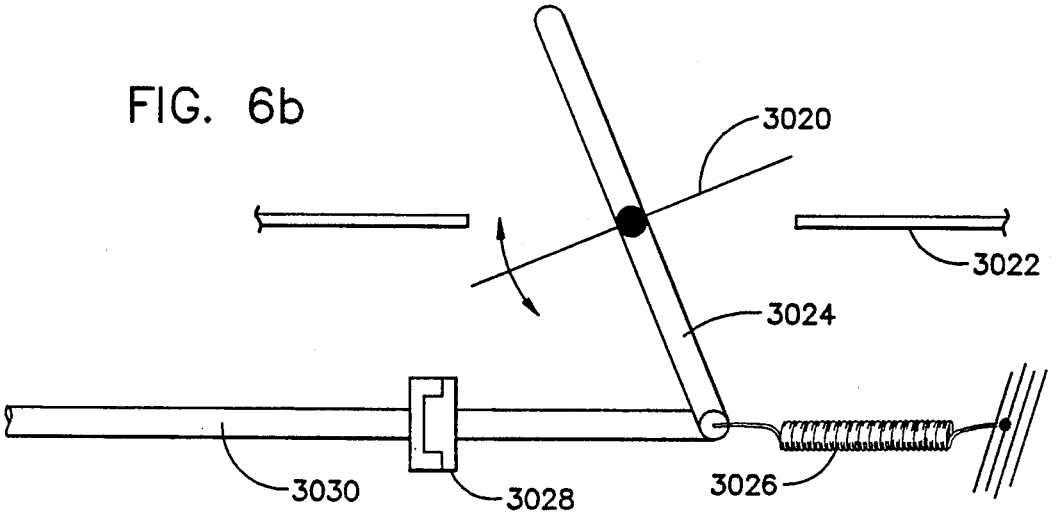
FIG. 6*b* is a side plan view diagrammatically showing the first embodiment of the servomotor previously shown in FIG. 6*a;*
Figure 7:
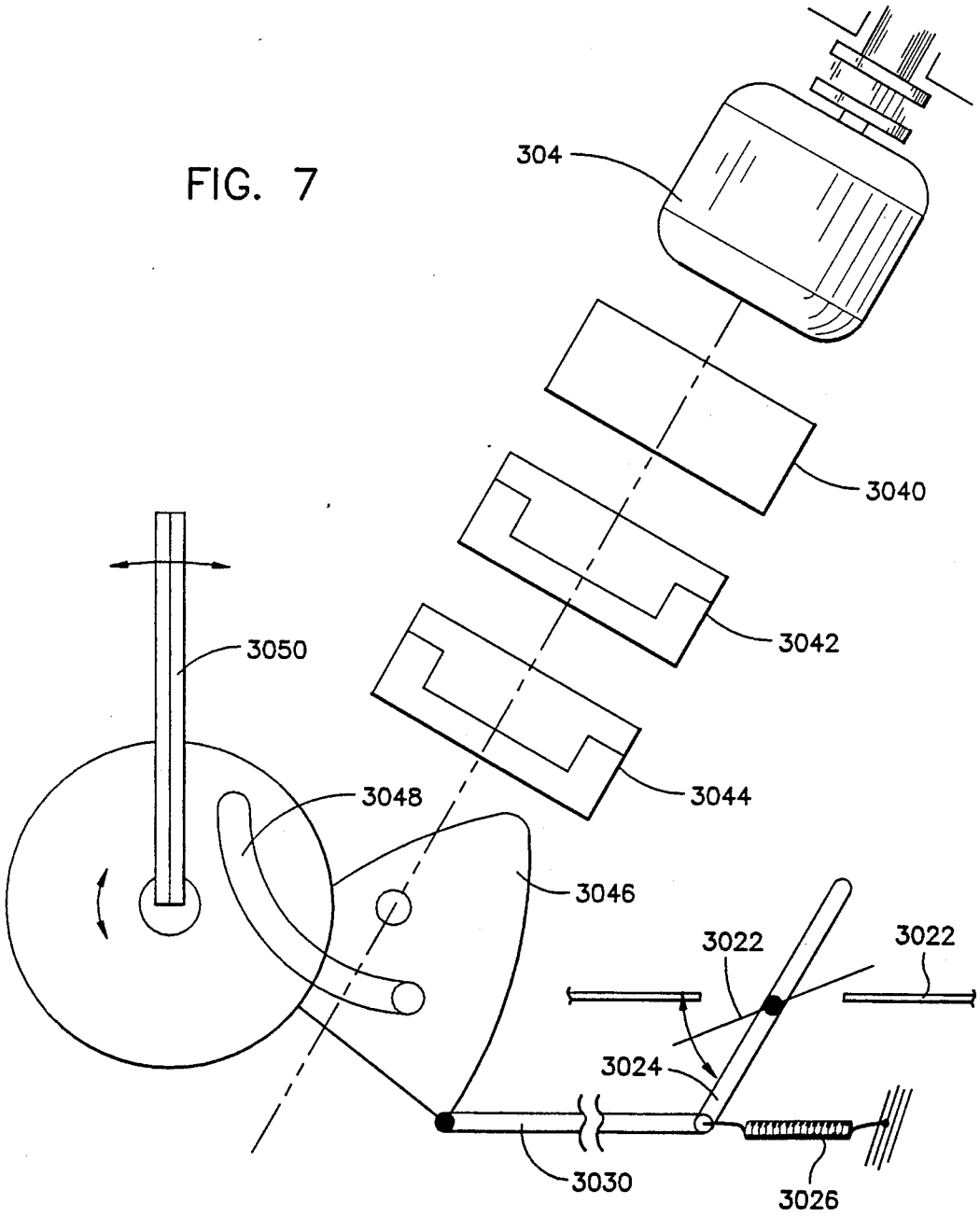
FIG. 7 is a side view diagrammatically showing a second embodiment of the servomotor previously seen in FIG. 1.

A first embodiment of a control system for a small boat engine's throttle shown in top view in FIG. 6*a* and in side view in FIG. 6*b* uses a servo motor 302, typically a small direct current motor. The servo motor 302 is hooked directly to a butterfly valve 3020, or like assembly, for controlling the air, fuel, or other intake to an engine. As may be best observed in the side view of FIG. 6*b*, the servo motor 302 operates to position the butterfly valve 3020 to control the throttle valve assembly on a carburetor of an engine and thereby the engine speed. The position of the butterfly valve 3020 is also typically controlled via a lever arm 3024 that is manually actuated through throttle cable 3030. The throttle cable 3030 connects to a throttle handle that is presented to the operator of a small power boat. Because the particular control which the butterfly valve 3020, and associated engine, receives from each of the throttle cable 3030 and from the servo motor 302 may be at times different, a clutch 3028 accords that only one control input, typically the manual input, shall be controlling in the event of conflict. Both the throttle displacement effected by servomotor 302 and by the throttle cable 3030 act against butterfly valve 3020 return spring 3026.

The first embodiment showing use of the servo motor 302 for engine throttle control and a small power boat shown in FIG. 6 obviously requires that the servo motor 302 should be intimately mechanically related to the internal mechanical, typically the carburetion, function of the engine. Since small boat engines may be presumed to be of differing constructions, a universal scheme of interconnection to and modification of small boat engines in order to achieve throttle control has proven difficult. Accordingly, the first embodiment shown in FIG. 6 is only occasionally preferred.

A second embodiment of the use of a servo motor, now identified as servo motor 304, in the control of the throttle of a small boat engine is diagrammatically illustrated in FIG. 7. An encoded servo motor 304 operates through an optional gear reduction 3040, an optional electronic clutch 3042, and an optional Torrington clutch as is required. The gear reduction 3040 is optionally employed if the power of encoded servomotor 304 is not directly sufficient to affect the necessary positional control of the throttle assembly including parts 3030, 3046, 3048, and 3050. The electronic clutch 3042 is used for optional disengagement of servomotor 3040 upon the assumption of manual control. It is required primarily where the encoded servomotor 304 (or its CRUISE CONTROL SERVO MOTOR DRIVER 300 shown in FIG. 1) is susceptible to damage by being overpowered and mechanically driven in reverse. The Torrington clutch 3044 is a unidirectional clutch. It locks the shaft in one direction of rotation and is free turning when rotated in the opposite direction of rotation. It is manufactured by the Torrington Division of worldwide Ingersoll-Rand. The Torrington clutch 3044 is used when spring 3026 is storing energy. Otherwise such Torrington clutch 3044 is not required.

The encoded servomotor 304 acts through its various gear reduction 3040 and clutches 3042, 3044 to drive a throttle connecting plate 3046 so as to affect movement of throttle cable 3030. This is the same throttle cable 3030 previously seen in FIG. 6. Its movement acting against spring 3026 controls via linkage 3024 the position of butterfly valve 3020 within carburetor 3022. The throttle plate 3046 is alternatively moved by action of the throttle handle 3050 acting through lever arm 3048.

The elements of a standard hand-controlled small boat throttle within the pictorial illustration of FIG. 7 will be apparent to a nautical engineer. A total small boat throttle control system design requires assessment of the friction forces in cable 3030, the return force of carburetor spring 3026, and the friction that is within the hand throttle mechanism 3046, 3048, 3050 as well as within the electronic throttle mechanism 304, 3040, 3042, 3044. The second embodiment of throttle control shown in FIG. 7 operates satisfactorily over a wide latitude of component selections, force ratios, and other factors, because the system time of response is normally adequate when measured in seconds and the system positional accuracy is normally adequate when measured in degrees.

4. Exemplary Microprogramming of the Velocity, Acceleration, and Trim Control System The microprogramming of uP 100 (shown in FIG. 1) in order to accomplish the desired velocity, velocity and acceleration, and/or small boat trim control functions in accordance with the present invention is, in general, relatively straight forward for sensing certain sensors and producing control outputs responsive to the conditions sensed. However, particularly in the preferred implementation of the trim control function both (i) complex trim control function and (ii) a wave action filter are preferably implemented. Therefore the power boat control accorded by the system of the present invention is sophisticated when required to obtain optimal results. This sophistication is readily supported by the microprogrammed control.

Figure 8:
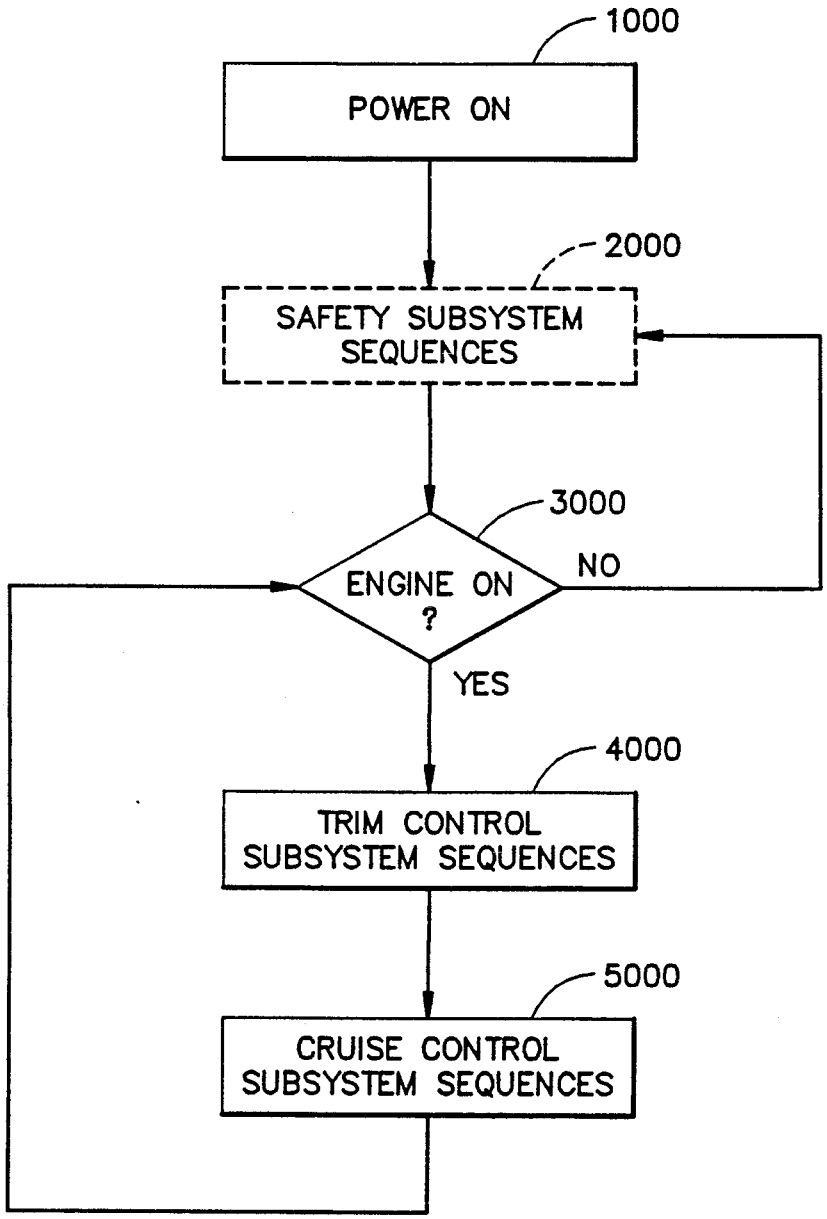
FIG. 8 is a first, top level flow chart of the microcode program performed by a computer processor, typically a microprocessor, of the control and safety systems of the present invention.

A first, top level block diagram of a system in accordance with the invention, including an additional, optional, safety subsystem, is shown in FIG. 8. The microprocessor 100 is self initializing upon the power on condition represented by block 1000, as is routine in the art of digital systems. The block SAFETY SUBSYSTEM SEQUENCES 2000 is performed only upon the optional inclusion of microcode for controlling a safety subsystem. This microcode, which deals with more discrete sensors and which is generally based on more subtle concepts than that microcode controlling velocity, acceleration, and/or trim, will be further dealt with in conjunction with FIGS. 11-23. Just as the sensors and controls involved with the optional safety subsystem were shown in dashed line within the hardware block diagram of FIG. 1, so also is the microcode for such safety subsystem shown in dashed line within the top level microcode flow chart shown in FIG. 8. The occurrence of the ENGINE ON CONDITION in BLOCK 3000 commences continuous cyclic execution of the TRIM CONTROL SUBSYSTEM SEQUENCES of block 4000 and the CRUISE CONTROL SUBSYSTEM SEQUENCES of block 5000.

The CRUISE CONTROL SUBSYSTEM SEQUENCES of block 5000 are not the subject of a further microcode flow chart for being essentially straightforward. By reference to FIG. 1, the microcode executed by uP 100 senses the boat's current speed, or velocity, through SPEED SENSOR 210 (also shown in FIG. 2). The microcode executed by uP 100 senses the current desired speed by data manually entered by the boat's operator at keyboard 350. If the keyboard 350 is extremely rudimentary, and is implemented by but a single two-position SPST switch, then it is still possible to manually enter the desired speed. In such a case the boat is manually run up to a particular speed and the single switch is then toggled, informing the microprocessor that this is the desired speed to thereafter be maintained.

The uP 100 takes the actual and desired speed information respectively from the speed sensor 210 and from the keyboard 350 and produces speed error information on the direction and magnitude by which the actual boat speed differs from the desired boat speed. This error signal is received by CRUISE CONTROL SERVO MOTOR DRIVER 300 and used to control servo motor 302, 304 which acts to control the throttle of the boat's engine, meaning the impetus of the boat's propulsion source. The control is so as to make the actual boat velocity more nearly equal to the desired boat velocity.

The optional control of acceleration in the CRUISE CONTROL SUBSYSTEM SEQUENCES 5000 is equally straightforward. The uP 100 shown in FIG. 1 preferably depends upon its own internal clock as a frequency standard from which time information may be derived. The uP 100 produces from this time information, and also from successive speed information received over a time interval from the speed sensor 210, the actual current acceleration/deceleration of the boat. Meanwhile, the microcode operating in uP 100 is informed of the desired acceleration/deceleration rate by manual data entry occurring at keyboard 350. The uP 100 calculates the difference by which the boat's actual acceleration/deceleration differs from the desired acceleration/deceleration, and uses this information in modifying the speed error signal that it produces for use by CRUISE CONTROL SERVOMOTOR DRIVER 300.

The modification of the speed control error information is so as to affect speed control of the power boat, when the speed error information is used to affect boat engine throttle control and the resultant boat speed, so as to make the actual acceleration/deceleration of the power boat to approximate the desired acceleration/deceleration while the power boat accelerates/decelerates to the desired speed. If the desired acceleration/deceleration is set higher than the engine capacity of the boat to accelerate the boat, or the retarding capacity of the hull to slow the boat, then the manually entered acceleration/deceleration control is essentially for naught, and the engine or hull attributes substantially control the respective acceleration or deceleration that the boat achieves. If, however, the desired acceleration/deceleration is relatively slow then the microprocessor 100 will slowly vary the speed error control signal in order to affect the desired gradual change in the boat's speed.

There typically exists a default value for the acceleration/deceleration control setting. This default value is intermediary between full throttle/full retard operation of the boat and a period of time so long that speed changes are not perceptible after a few seconds. The boat user may typically change this default setting so that the boat will respond, upon its repetitive use, in accordance with predetermined acceleration/deceleration performance.

FIG. 1*b* shows LCD display 342, a keyboard 350 and a memory 360. These elements represent one embodiment of how multiple user speed and acceleration settings may be stored. After a skier finds his preferred acceleration and speed setting then his/her settings are entered into a unique address of memory 360 thru the keyboard 350. When those settings are desired to be used again then they are recalled from memory 360 with keyboard commands, verified on the display and used by uP 100 to affect speed and acceleration control. The use of nonvolatile memory, normally of the EEROM type is preferred so that preset speed and acceleration parameters for multiple skiers may be retained during long periods when the boat is not in use and the system 16 has been turned off.

5. Trim Control in Accordance with the Present Invention

The control of power boat trim in accordance with the present invention is enabled by that microcode of the TRIM CONTROL SUBSYSTEM SEQUENCES shown in block 4000 of FIG. 8. This microcode is shown in greater detail in the second, intermediate level flow chart of FIG. 9, and in still greater detail for the WAVE ACTION FILTER 4100 in the third, bottom level flow chart of FIG. 10.

The trim control in accordance with the present invention is not directly determined by using a look up table and read only memory (ROM) storing the trim angle of the boat as a function of boat speed as was commonly performed in the prior art. Rather, the trim angle of the boat is determined directly by interrogation of the analog inclinometer/accelerometer sensor 230, 232 (shown in FIG. 1). The detected trim angle is used to produce a signal output to either the "UP" TRIM SOLENOID DRIVER 310 and its "UP" TRIM SOLENOID 312, or else the "DOWN" TRIM SOLENOID DRIVER 320 and its "DOWN" TRIM SOLENOID 322 as the case may be, in order to control the trim of the boat. The objectives of trim control are (i) minimization of changes in boat orientation during acceleration/deceleration between the stopped and on-plane conditions, and (ii) efficiency of operation while in the on-plane condition. Particularly, the trim control system maintains the boat in level trim in the on-plane condition. Level trim means that the propulsion drive of the boat is operating in a plane substantially perpendicular to the surface of the water regardless of the angle of the hull of the boat to the surface of the water when the boat is on-plane.

The preferred microcode for implementation of the TRIM CONTROL SUBSYSTEM SEQUENCES 4000 in accordance with the present invention particularly incorporates a WAVE ACTION FILTER 4100. The WAVE ACTION FILTER 4100 maintains an historical record of recently sensed boat inclination/acceleration changes. If these changes are going both positive and negative about a zero inclination, the WAVE ACTION FILTER 4100 will act to assume that the boat is encountering water turbulence, and is otherwise substantially at the correct trim position. Thus the output of this FILTER 4100 to subsequent filters and into microcoded routines for matching the trim sender and inclinometer angle will be reduced, or even set to zero. The action of the wave action filter ensures that the high sensing speeds of each of the inclinometer/accelerometer SENSOR 230, 232, the analog to digital conversion of the ADC 200, and microprocessing the of uP 100 (all shown in FIG. 1*a*) do not overdrive the solenoid drivers 310, 320 and associated solenoids 312, 322. As well as precluding that the trim control should undesirably "hunt" or oscillate, the WAVE ACTION FILTER 4100 puts a variable damper on the rapidity of trim control, and helps to give a smoother attitudinal response of the boat with varying speed, as is normally desired.

If the filtered output of WAVE ACTION FILTER 4100 is greater than a predetermined value, typically 10°, then it can be assumed the boat is between its rest position and its on-plane condition and therefore needs both upward thrust and forward thrust to assist the boat into its on-plane condition. When this predetermined value is measured the trim is moved to its full down (or −4°) position. It is held there until the boat again reaches an attitude less than the predetermined value. At this time the trim sender angle is matched with the inclinometer angle in order to provide optimal forward thrust of the boat.

Figure 10:
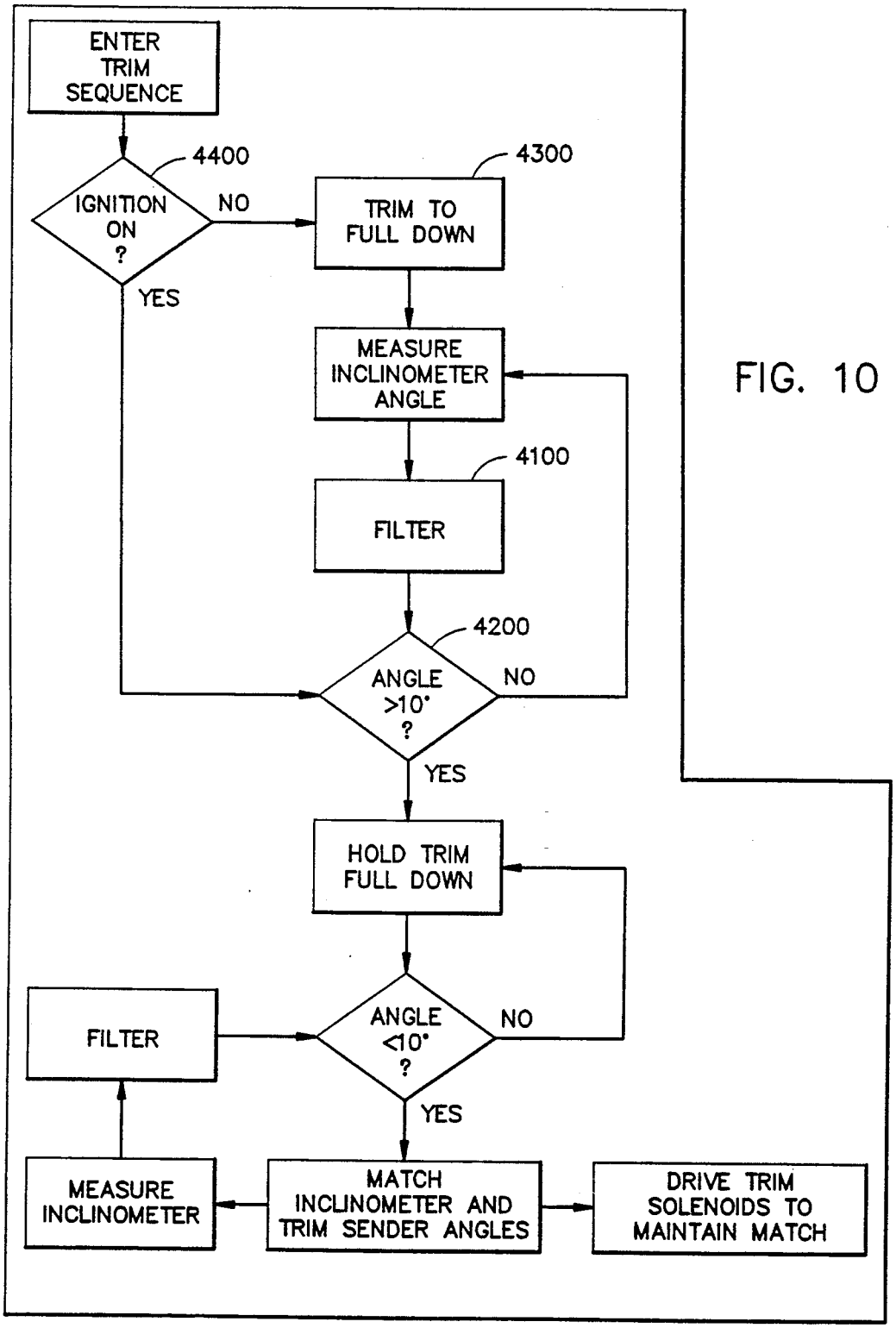
FIG. 10 is a third, bottom level flow chart of the microcode executed by the microprocessor of the system of the invention, particularly in implementation of a digital low pass, or wave action, filter.

This implementation of WAVE ACTION FILTER 4100 just described is not the only implementation possible utilizing an inclinometer. FIG. 10 shows an alternative embodiment of the WAVE ACTION FILTER 4100 and associated routines that additionally sense the ignition state in block 4400. If the ignition is determined to be in its off state, either by a zero output from the FREQ MEAS circuit 2260 shown in FIG. 1*a* or through a separate (unshown) ignition sensor, the hull is assumed to be at rest and the outdrive is moved to its full down condition as shown in block 4200.

Other embodiments of WAVE ACTION FILTER 4100 utilizing hull speed or engine RPM will now be obvious to the routineer.

Figure 9:
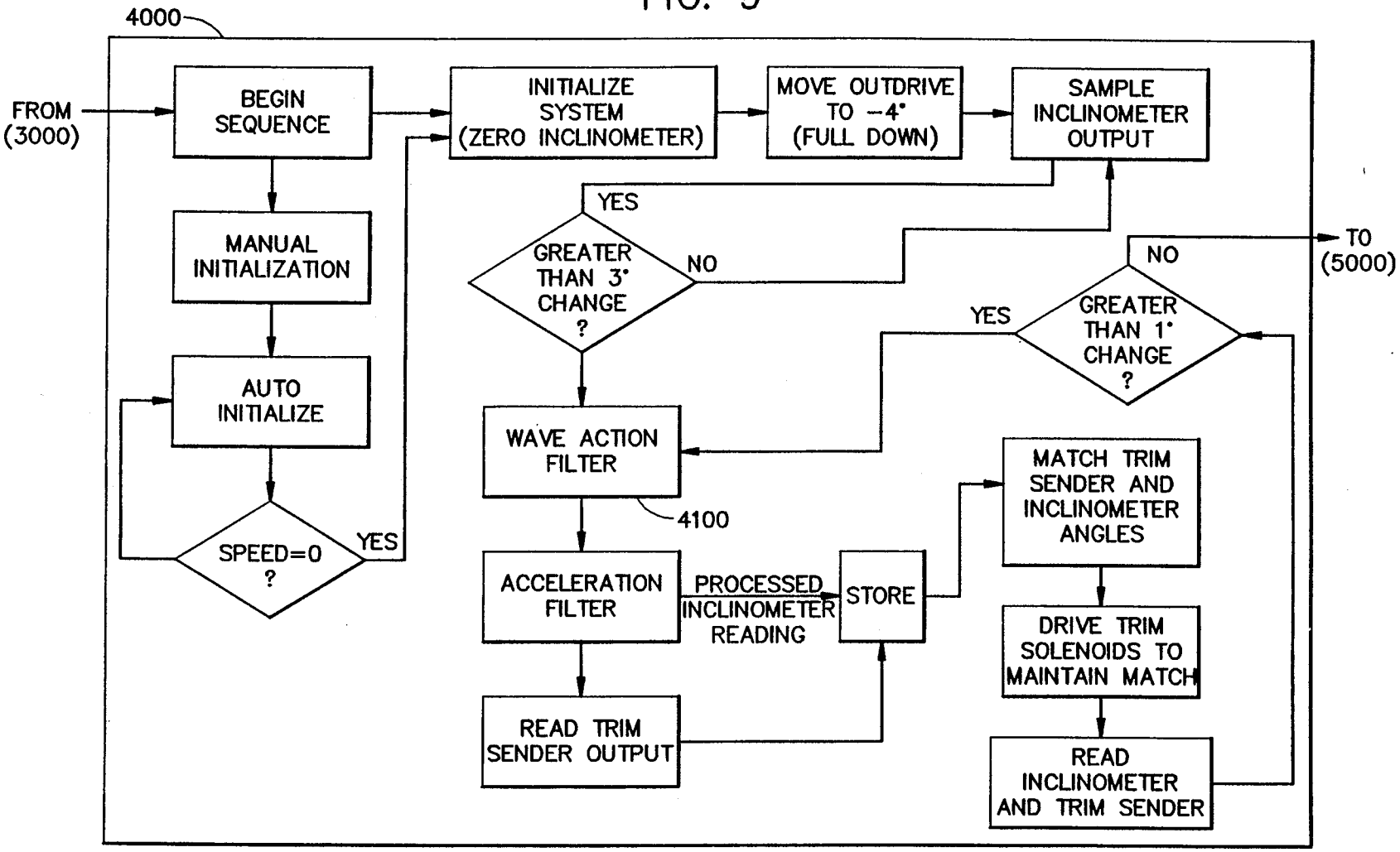
FIG. 9 is a second, intermediate level flow chart of the microcode performed by the microprocessor of the system of the invention, particularly in implementation of the trim control function.

The microcode for trim control block diagram in FIG. 9 is obviously insensitive to the loading of the power boat, or the distribution of the load within the power boat's hull. It operates to essentially automatically maintain the boat at optimum trim during varying conditions of load, speed, and sea state.

6. Safety Subsystem for Small Power Boats

An optional safety subsystem for small power boats is compatibly incorporated within and realized by the speed, acceleration and trim control system 10 in accordance with the present invention. Alternatively, such a safety system is implementable as a stand alone microprocessor-based system. A safety subsystem includes those elements shown enclosed within dashed line in the hardware block diagram of FIG. 1. To realize a safety subsystem, uP 100 additionally executes that microcode for the SAFETY SUBSYSTEM SEQUENCES 2000 that is shown in a dashed line block within the first level flow chart of FIG. 8.

Figure 11:
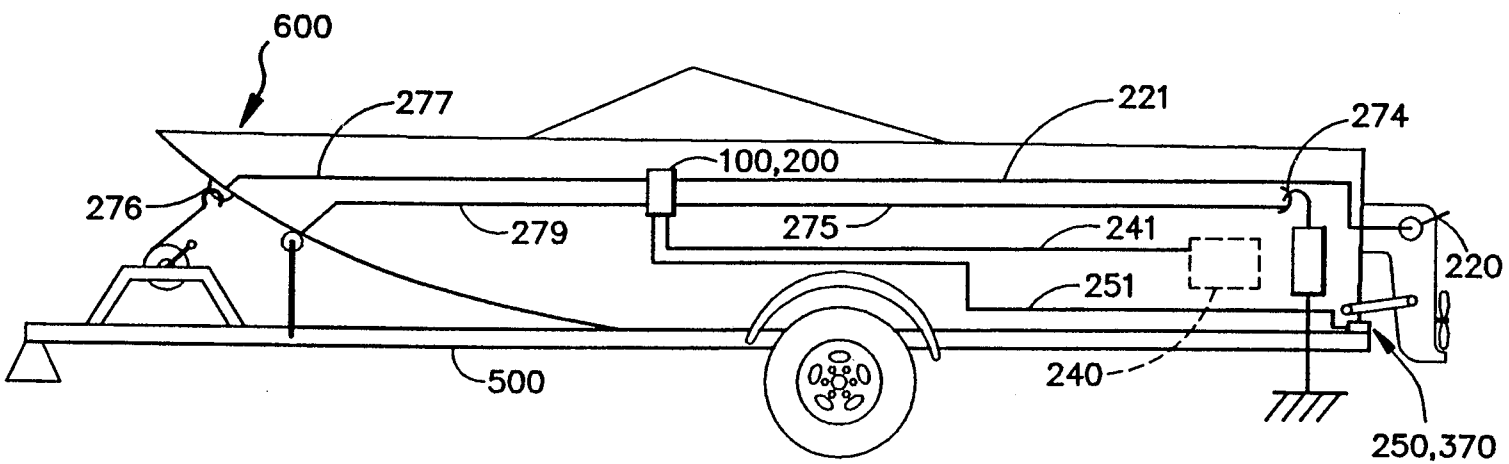
FIG. 11 is a pictorial diagram showing the location of sensor and other components of an electronic safety system, previously seen in schematic diagram in FIG. 1, for a trailerable power boat and its trailer.

A pictorial representation of how the sensors of a safety subsystem are connected to a trailerable power boat 600 and its trailer 500 is shown in FIG. 11. The uP 100 and its associated ADC 200 (previously shown in FIG. 1) are depicted to be physically located at a nominal central position within the power boat 600. A BOW STRAP SWITCH 276 is connected by signal line 277, actually a one signal line of bus 101, to uP 100 (all shown in FIG. 1). Similarly, a PORT STERN STRAP SWITCH (2) 274 is connected by signal line 275 to a first one of an additional two signal lines of bus 101 of uP 100. A final strap switch, not visible in FIG. 10, is the STARBOARD STERN STRAP SWITCH 272. This switch is connected by signal line 273 to a second one of the two additional signal lines of bus 101 to uP 100. The STRAP SWITCHES 272, 274, 276 are preferably the straps themselves which, by act of connection and disconnection, serve as simple SPST switches. The signal lines 273, 275, 277 connected to such switches are biased, as may be best observed in FIG. 1, by voltage line 281 derived from PULSE SENSE LINE DRIVERS 400 by connection through pull up resistors 280. The STRAP SWITCHES simply serve to indicate the strapped connection of the boat 600 to the trailer 500. A common electrical ground is established between boat 600 and trailer 500 by ground signal line 279 shown in FIG. 10.

The TRIM SENDER SENSOR 220 (previously seen in FIG. 1), is located on the propulsion drive of the boat 600. It sends the current trim angle via wire 221 to ADC 200 and then to uP 100.

A BILGE VALVE SOLENOID SENSOR 250 communicates via signal line 251 to ADC 200 and thence to microprocessor 100. At the same location within the boat, and associated with the SOLENOID SENSOR 250, is the SOLENOID-ACTUATED BILGE VALVE 370. The SOLENOID-ACTUATED BILGE VALVE 370 is, however, connected to uP 100 through bus 103, as is best observed in FIG. 1.

Finally, the ENGINE COMPARTMENT LOWER EXPLOSIVE LEVEL SENSOR 240 communicates through signal line 241 to ADC 200 and then to uP 100. The SENSOR 240 normally has a direct link (not shown in FIG. 1) to ENGINE COMPARTMENT BLOWER MOTOR DRIVER 330, as well as the communications path proceeding through uP 100. The resultant logically ORed redundancy in the enablement of ENGINE COMPARTMENT BLOWER MOTOR DRIVER 300 is for safety, and to keep the boat's engine compartment free of explosive fumes even if the safety subsystem was not implemented or inoperative.

One appropriate SENSOR 240 is the gas vapor analyzer available from Aqua Meter® Instrument Corporation. This analyzer both detects the lower explosive limit and displays the resultant conditions. Detectors of this type are typically used to alert the boat user of dangerous conditions and require a human response to correct the dangerous condition. This embodiment uses a closed loop control system to keep the engine compartment safe without generally having the boat operator intervene. The sensing to uP 100 permits that the ignition be automatically disabled by the safety subsystem at some fixed percentage of the LEL and above. Also the fan is typically turned on periodically, or under start up conditions, by the safety subsystem for a long enough period to sample the fumes and determine the LEL to be safe.

In the simplest and least costly implementation of the safety subsystem, the lower explosive limit detector is eliminated completely. The engine compartment fan is automatically turned on under predetermined conditions for predetermined times (often times recommended by the boat manufacturers) to dispell potentially explosive vapors from the engine compartment. Referring to FIG. 1; the ignition sensor 290 sends a signal to the uP 100 which measures the time (using its internal clock) that has elapsed since the engine was last turned off. If the time exceeds a predetermined value(s), then the uP 100 disables the ignition and enables the engine compartment fan driver 330, thus starting the fan. The fan is turned off after the prescribed time(s) has elapsed and the ignition is reenabled, thereafter permitting the engine to be started. The engine RPM 262 is periodically measured to sense the on/off state of the engine. If the engine is off then the internal timer in microprocessor 100 is reset so that the above sequence will repeat if a predetermined time elapses before the engine is restarted.

Momentarily referencing FIG. 1, the function of sensing the flow communication of the boat's bilge performed by BILGE PLUG SWITCH 270 communicating through signal line 271 on bus 101 to uP 100 may be alternatively realized through an analog signal output from BILGE VALVE SOLENOID SENSOR 250. The switch 270 and SENSOR 250 are alternative embodiments of the same function: sensing the condition of the bilge valve.

Also within the safety subsystem are ALARMS 380 which provide audio and/or visual alarms to the boat operator, CONTROLS 390 by which the boat operator may sequence occurrences within the safety subsystem and provide data inputs thereto, and the PULSE SENSE LINE DRIVERS 400 which provide controllable voltage actuation to discrete sense lines such as sense lines 271, 273, 275, 277 respectively connecting to switches 270, 272, 274, and 276. The control of PULSE SENSE LINE DRIVERS 400 by uP 100 acting through bus 103 permits that the discrete lines that are connected to the bus 101 are not normally energized. In this state they do not interfere with the interrogation of units such as FREQ MEAS 260 and ADC 200 during use of the bus 101 by uP 100. When all of the SWITCHES 270, 272, 274, 276 are to be interrogated the uP 100 controls that PULSED SENSE LINE DRIVERS 400 should raise voltage on line 281 to the logic high condition.

2. Solenoid Actuated Automatic Bilge Plug Valve

As with the speed, acceleration and trim control system 10 block diagram in FIG. 1, most of the elements used in implementing the safety subsystem are of standard construction and readily available. One element that is preferably of special construction is the BILGE VALVE SOLENOID/SENSOR 250, 370.

The BILGE VALVE SOLENOID SENSOR 250, 370 (shown in FIG. 1) fits within the boat 600 (shown in FIG. 11) at the position of hole 606 that is normally located at the juncture of transom 604 and bilge 602. In this position it may be selectably disabled for allowing drainage of the bilge 602 to the exterior of boat 600.

Figure 12A:
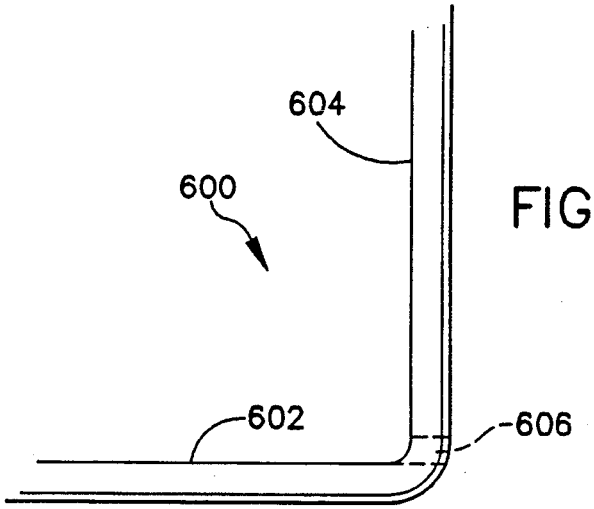
FIG. 12*a* shows a bilge of a power boat where an electrically interrogatable bilge valve in accordance with the present invention is located.
Figure 12B:
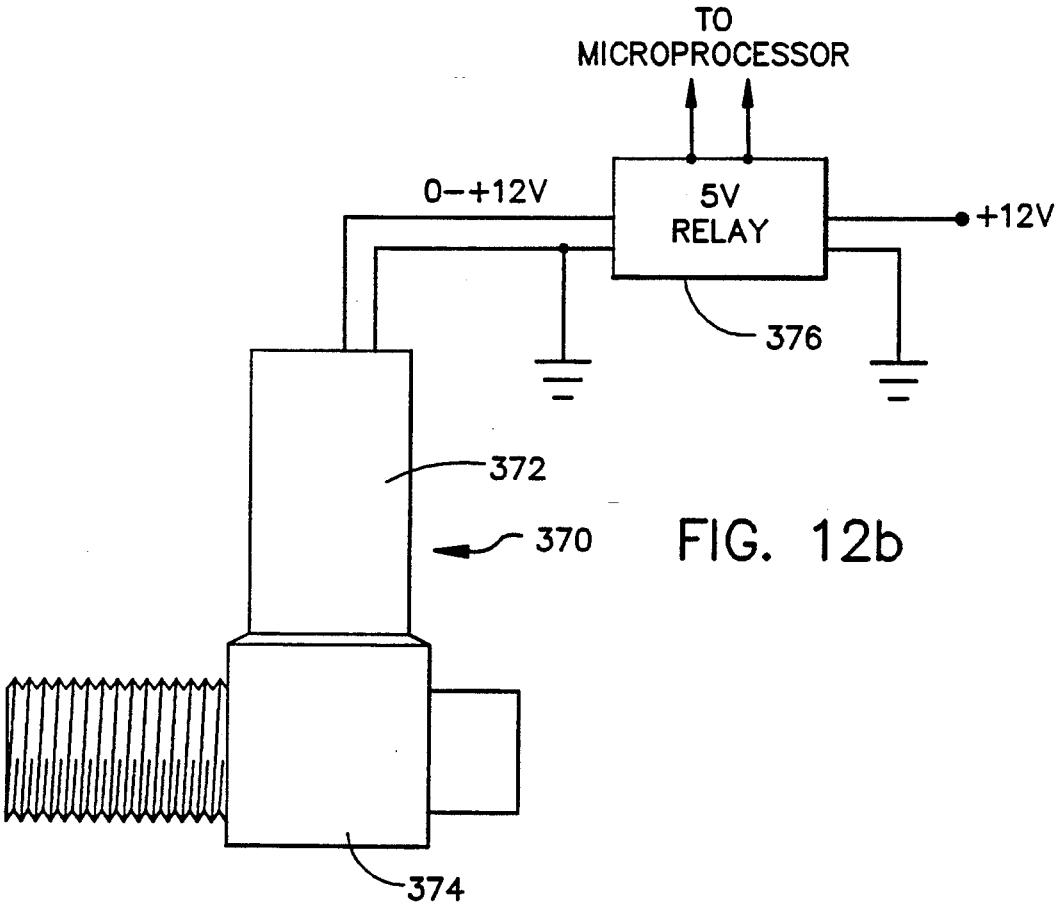
FIG. 12*b* shows a schematic diagram of the electrically interrogatable bilge valve in accordance with the present invention, which bilge valve is used within the electronic safety system in accordance with the present invention.

A pictorial diagram of the electrical connection of SOLENOID-ACTUATED BILGE VALVE 370 is shown in FIG. 12*b*. The valve housing 374 is normally open. The opening and closing of the valve housing is enabled by a direct current solenoid 372. The solenoid 372 is itself controlled by a 5volt relay which normally selectably connects a 12 volt dc power source, normally the boat's main battery. The actuation of the 5 volt relay 376 is enabled by microprocessor 100 through two signal lines of bus 103 (shown in FIG. 1).

Figure 12C:
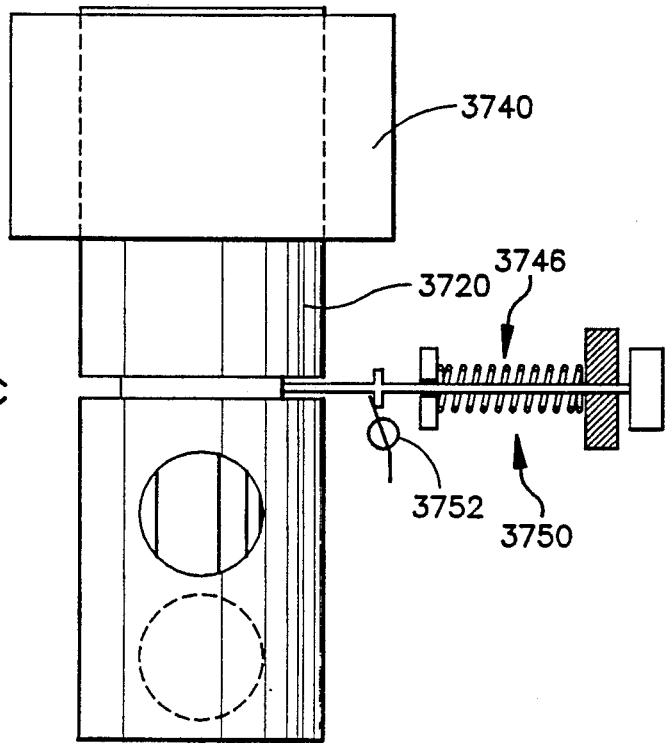
FIG. 12*c* and FIG. 12*d* respectively show a pictorial mechanical representation of the electrically interrogatable bilge valve of the present invention that is used within the electronic safety system in accordance with the present invention in its closed and open positions.
Figure 12D:
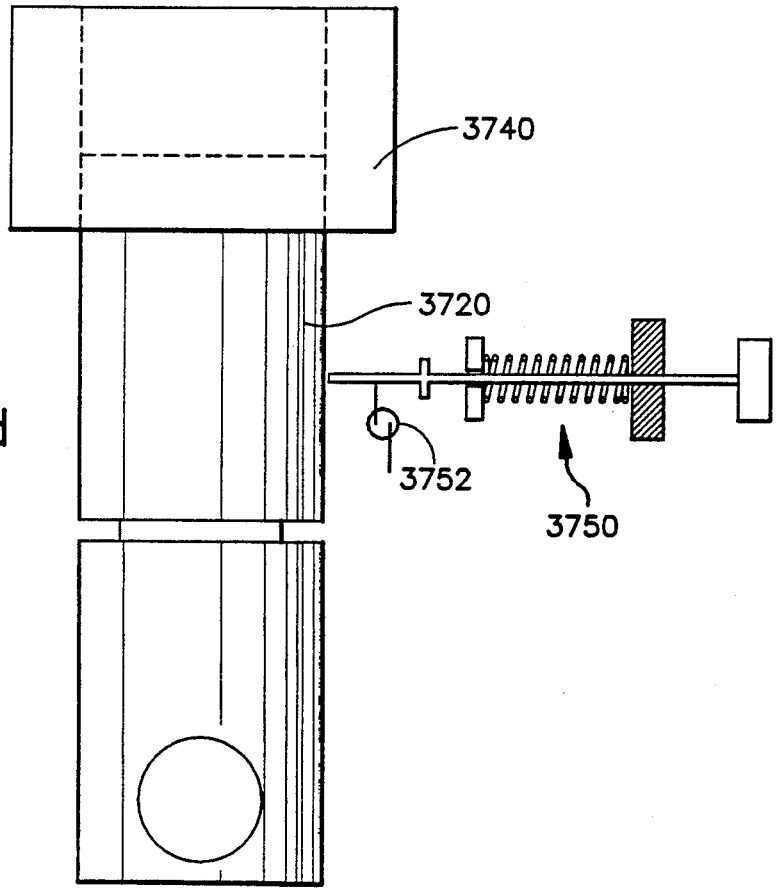

Mechanical pictorial diagrams of the closed and open conditions SOLENOID-ACTUATED BILGE VALVE 370 are respectively shown in FIGS. 12*c* and 12*d*. The SOLENOID PLUNGER 3720 has a valve latching mechanism 3746 that mechanically maintains the valve closed, occluding the free port 3748 that is open to the bilge drain, without application of power. This prevents any unnecessary battery power drain and prevents the boat from sinking when the battery is turned off.

It is desirable to have a "free ported" valve as illustrated. Such a valve allows straight thru, unobstructed flow such as is obtained with a ball valve or a cylinder valve. Solenoid valves of this type are available from Worster Controls. Free ported valves are easy to clean of leaves, debris, etc.

Opening of the SOLENOID-ACTUATED SOLENOID VALVE 370 requires both the application of current to direct current solenoid 372 under control of microprocessor 100 and a manual release of the latch of the valve. In this manner a failure of the microprocessor uP 100, or a fault on bus 103, cannot alone result in the undesired opening of the SOLENOID-ACTUATED BILGE VALVE 370, and the sinking of the boat. It is also desirable to lock the valve in position so it must be deliberately and manually opened. A spring-catch mechanism 3746 is one way to accomplish that.

Sensing whether the valve is latched closed can be accomplished by several means. One such means is a light detection system that senses the position of the latching mechanism. Another means is a microswitch or magnetic proximity sensor that is triggered either by the latching mechanism or the solenoid plunger. A microswitch 3752 is shown in the closed and open positions in FIGS. 12*c* and 12*d*. Finally, a secondary winding may be placed around the solenoid plunger. The primary winding is pulsed and the secondary winding is sensed. In one position a pulse will reach the secondary windings, in the other no pulse will be measured on the winding.

Signals sensed by the opening of stern straps 272, 274 shown in FIG. 11 and FIG. 1 are used to signal an impending launch condition and close the bilge valve 370.

8. Microprogrammed Control of the Safety Subsystem

The safety subsystem shown in electrical block diagram within FIG. 1, and in pictorial representation in FIG. 10, is controlled by a microprogram executed by uP 100 (shown in FIGS. 1 and 10). The microprogram interacts with the boat operator acting through controls 390 for sequencing common operations associated with the launching, use, recovery, and trailering of small power boats.

Figure 13:
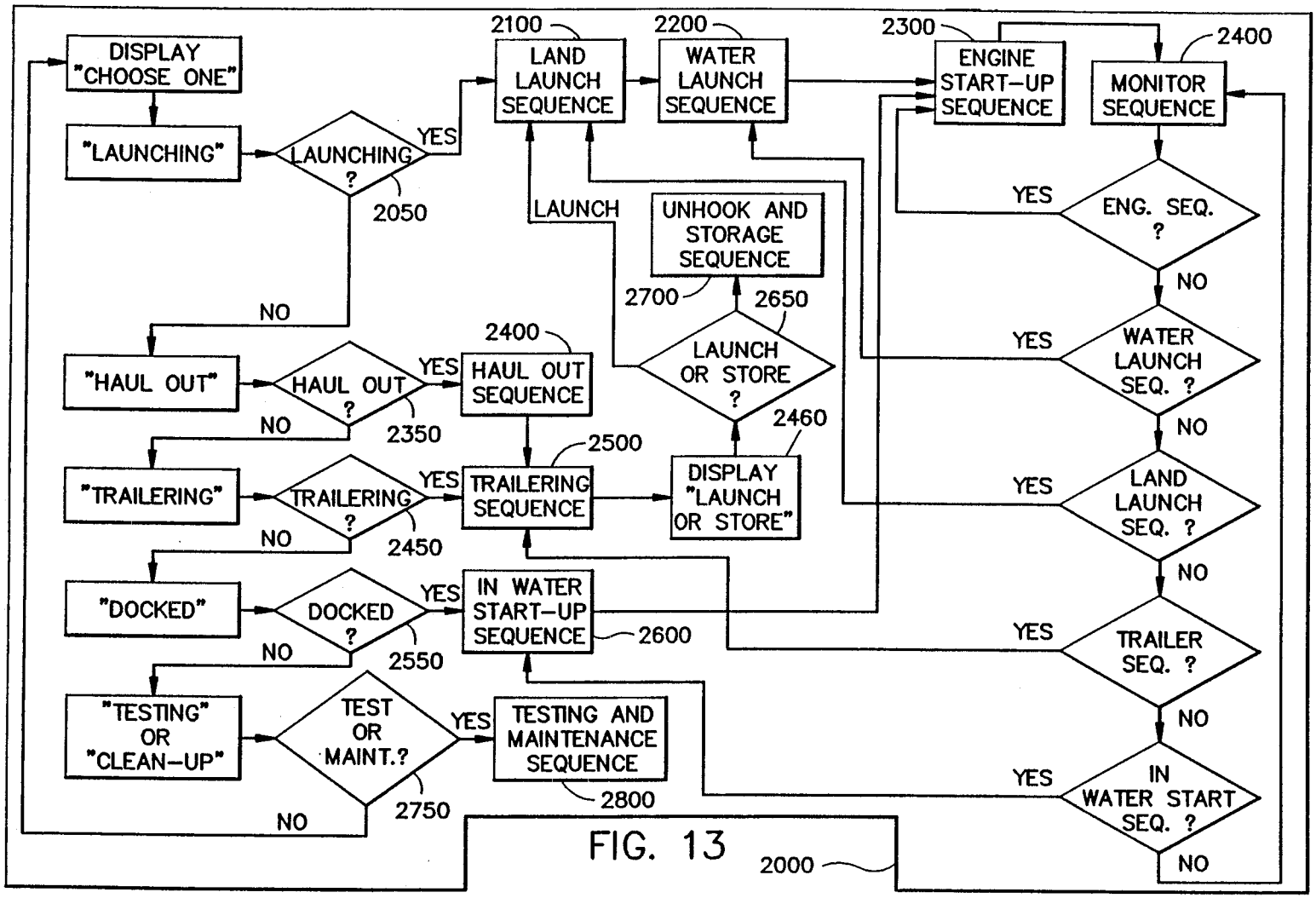
FIG. 13 is a second, intermediate level flow chart showing the microcode executed by the microprocessor of the electronic safety system in accordance with the present invention particularly in performing the comprehensive safety system functions.

The SAFETY SUBSYSTEM SEQUENCES shown in block 2000 of FIG. 8 cause the sequencing through a number of display modes that are illustrated at the left of FIG. 13. An appropriate operator response to any of the inquiries results in an entrance into an associated mode. Entrance into the various microprogram subroutines for aiding, instructing, and alarming the operator during certain boat conditions is also dependent upon the condition of certain sensors.

The conditions of the boat's sensors which are appropriate to enter associated microprogram sequences 2100–2800 are shown in tabular form in FIG. 14. The microprogram residing in uP 100 monitors those sensors shown in FIG. 1 which are indicative of the engine operation, attachment of the bow and sterns hooks, lower explosive level in the engine compartment, status of the bilge plug, status of the boat's propulsion relative to its trailering position and status of the boat's trim. In accordance with the table of FIG. 14, a sequence is entered when the sensed conditions are so as to respectively satisfy all positions labeled "0" meaning negative or "1" meaning positive within a column of the table. Positions labeled "D" stand for "Don't Care", and are not relevant to entering or not entering the associated microprogram sequence.

Figure 15:
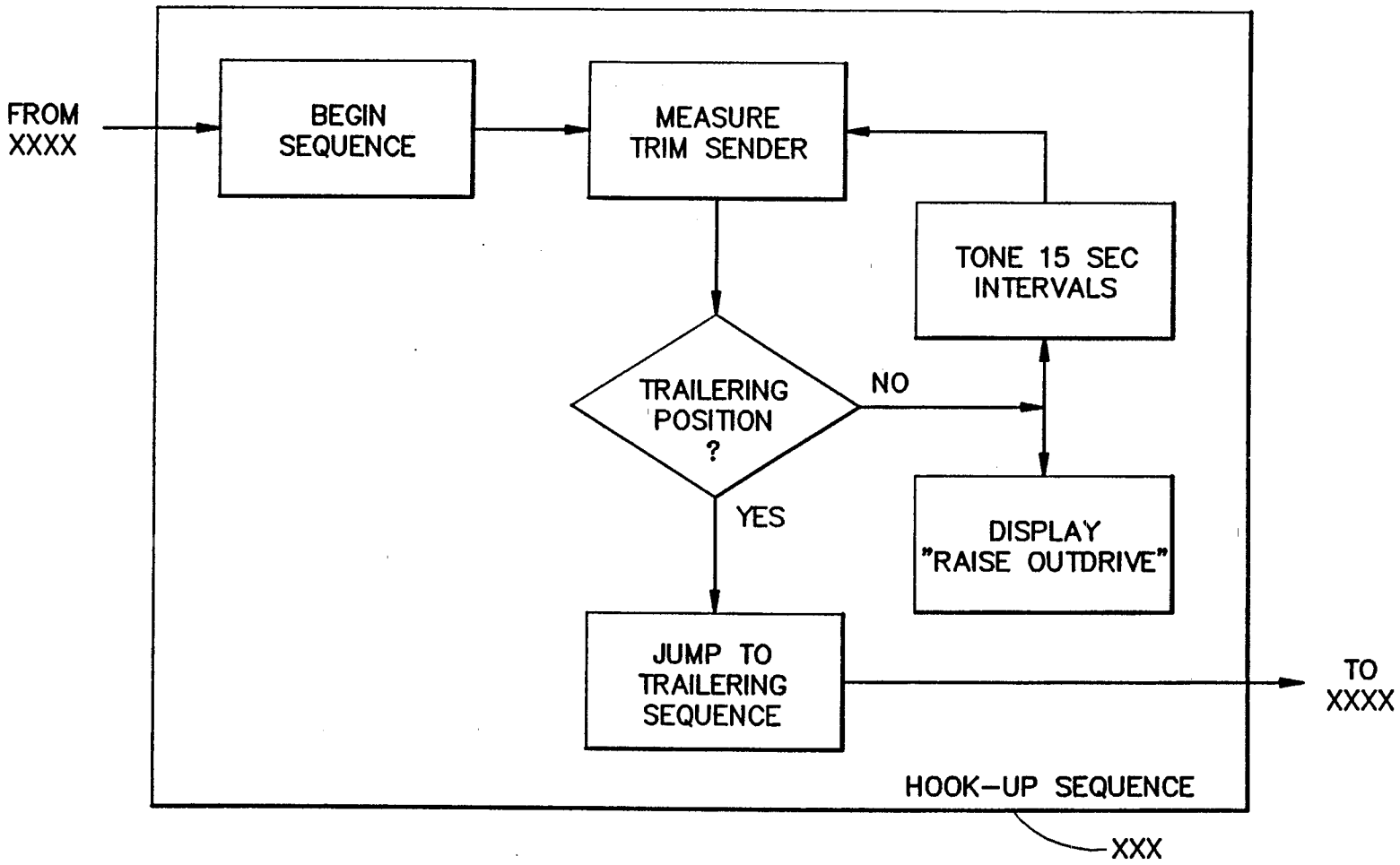
FIG. 15 is a third, bottom level flow chart showing the microcode particularly controlling the hook-up sequence of the safety system in accordance with the present invention.

The hook-up sequence of microprogrammed operation is shown in detail block diagram in FIG. 15. The sequence is entered upon operator indication that the boat is desired to be hooked to its trailer. The sequence directs the operator to position the boat's trim to the appropriate trailering position. Automatically raising the outdrive is simple to implement but could endanger a person located near the outdrive. It is therefore not the preferred embodiment.

Figure 16:
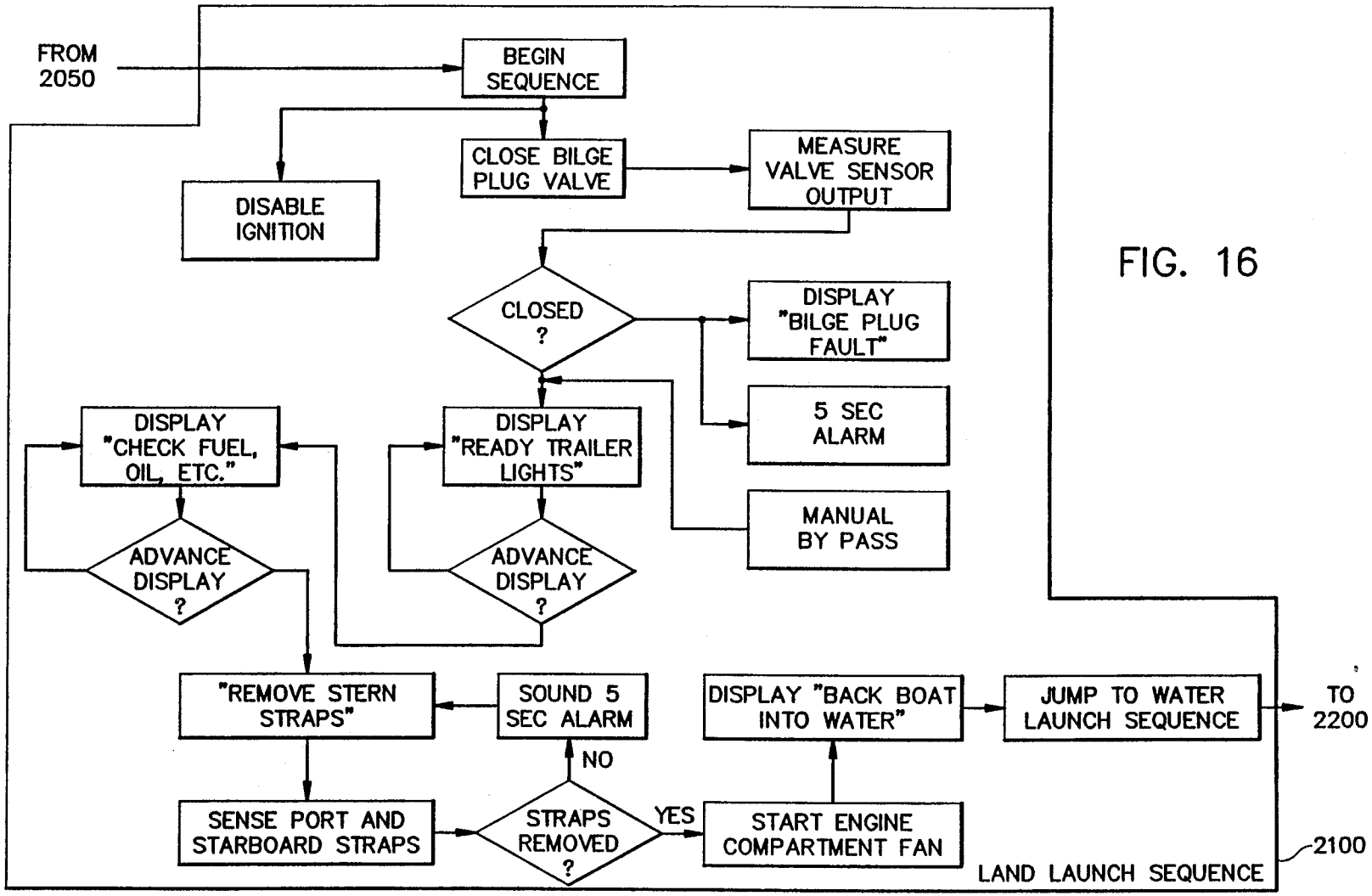
FIG. 16 is a third, bottom level flow chart showing the microcode particularly controlling the land launch sequence of the safety system in accordance with the present invention.

The LAND LAUNCH SEQUENCE 2100 of microprogrammed operations is block diagrammed in FIG. 16. As may be observed from FIG. 13, the sequence is also entered upon manual selection of a launch mode. It serves to sequence a number of messages and determine a number of conditions which will direct the boat owner to correctly configure the boat and its trailer while it is still upon the land for the subsequent backing of the trailer into the water and the off loading of the boat from the trailer into the water.

Figure 17:
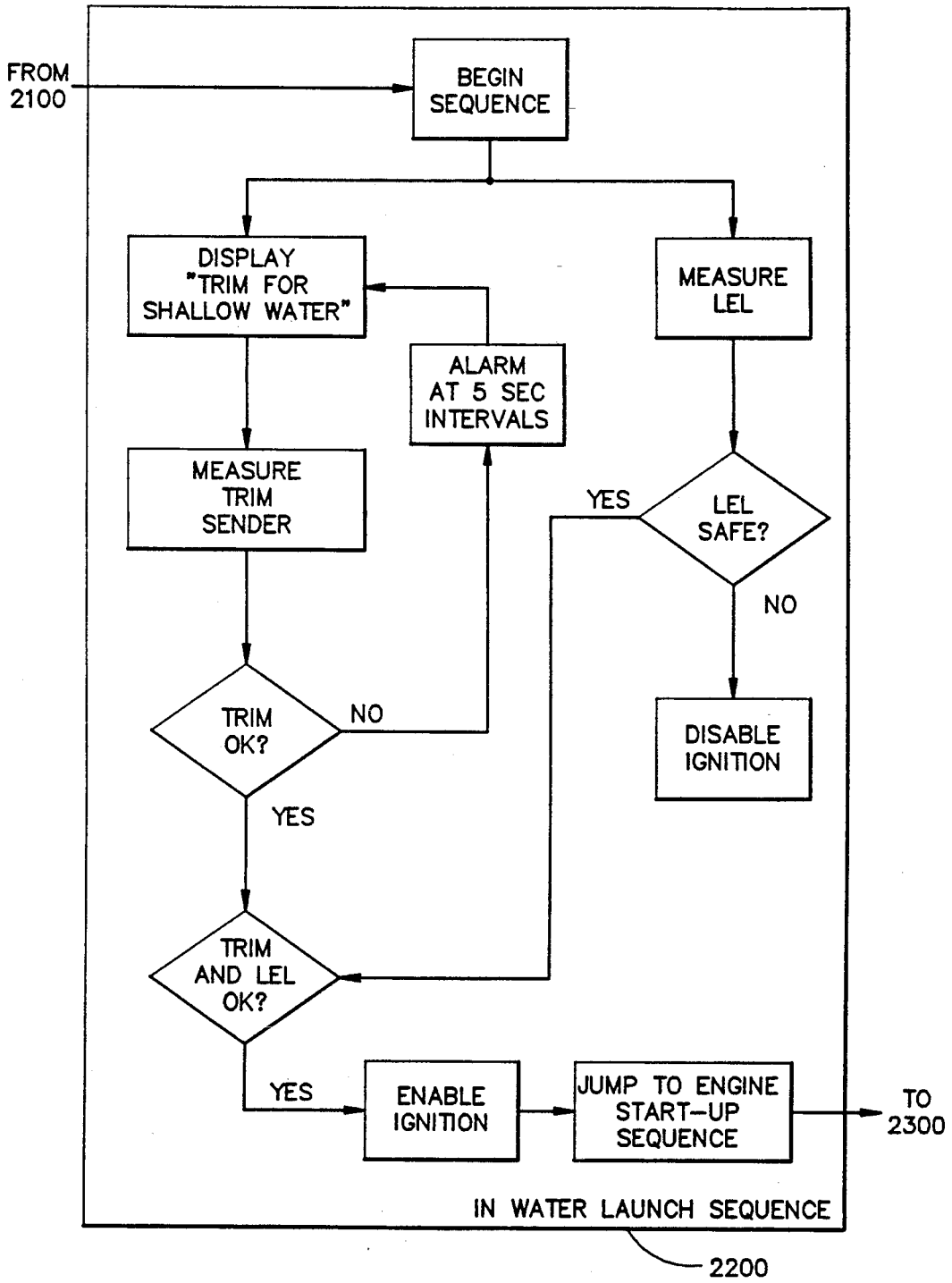
FIG. 17 is a third, bottom level flow chart showing the microcode particularly controlling the in-water sequence of the safety system in accordance with the present invention.

The microprogrammed operations attending off loading into the water, or IN-WATER LAUNCH SEQUENCE 2200, are block diagrammed in FIG. 17. The microprogram principally monitors the trim condition and the lower explosive level indicator of the engine compartment before determining that the boat is sufficiently properly configured to support the engine start-up sequence 2300.

Figure 18:
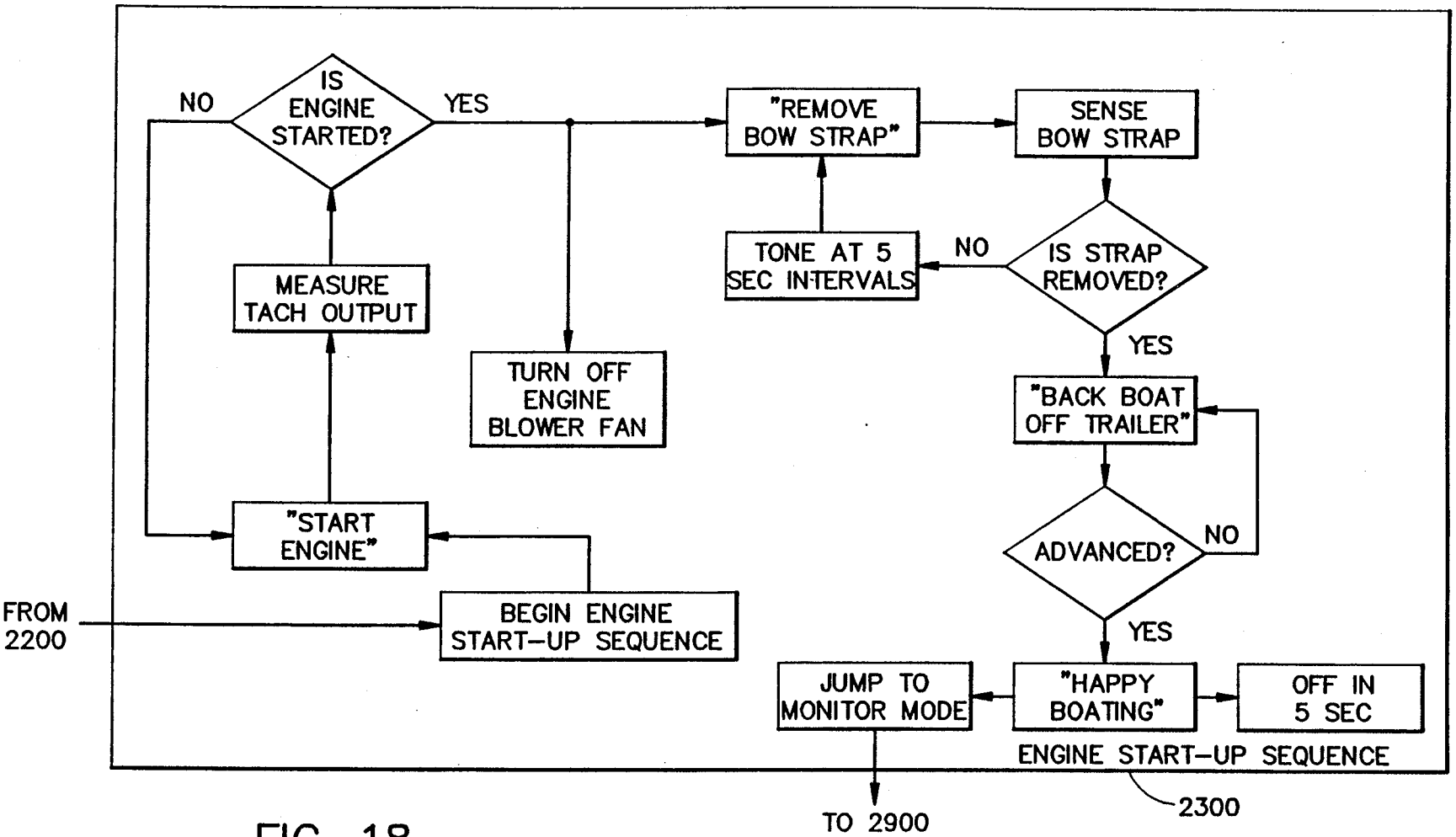
FIG. 18 is a third, bottom level flow chart showing the microcode particularly controlling the engine start-up sequence of the safety system in accordance with the present invention.
Figure 19:
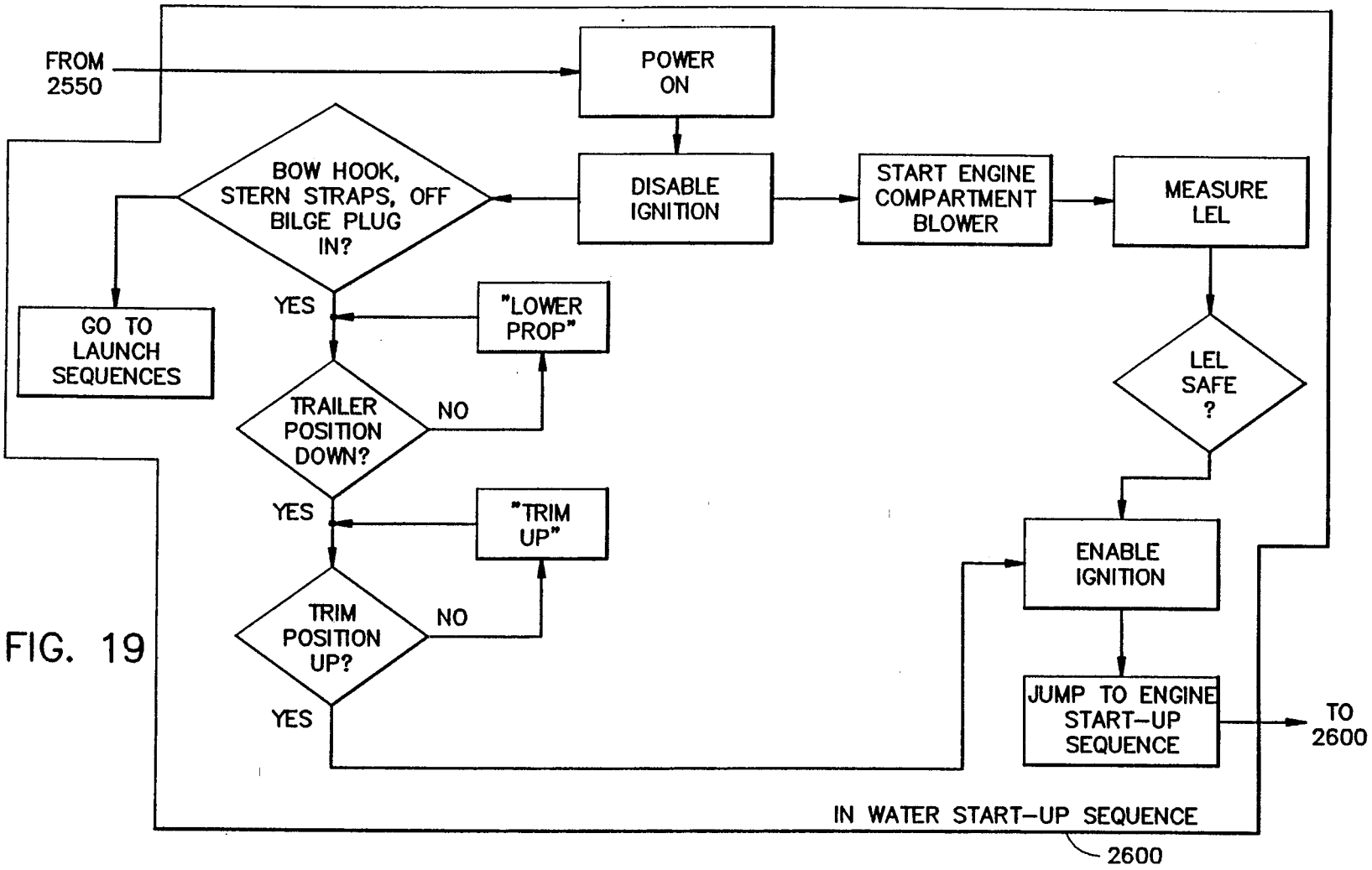
FIG. 19 is a third, bottom level flow chart showing the microcode particularly controlling the in-water start-up sequence of the safety system in accordance with the present invention.

The ENGINE START-UP SEQUENCE 2300, which may be entered from additional points of the microprogram control than merely the in-water launch sequence 2200 shown in FIG. 17, is block diagrammed in FIG. 18. The sequence interrogates the tachometer to check the operating or non-operating condition of the engine, or interrogates the bow strap sensor to check that the bow strap is removed, or preferably, checks both sensors to confirm both that the engine is not operating and that the bow strap is removed. If one or more unsatisfactory conditions for starting the engine are sensed, a message, preferably in the form of an audio tone is presented to the boat operator. If satisfactory conditions are sensed another message, normally a displayed salutation of "Happy Boating", is displayed to the boat operator The IN-WATER START-UP SEQUENCE 2600 is block diagrammed in FIG. 19. The sequence validates that the power boat is correctly configured so that its engine may be started while the boat is in the water. The sequence starts by first disabling the engine ignition. It then monitors a bow hook sensor for information that the power boat is or is not attached at its bow to its trailer or other object, and the stern hook sensor to determine that the power boat is or is not attached at its stern to its trailer or other object. The sequence monitors the bilge plug sensor to determine that the bilge of the power boat is not flow communicating with the exterior of the boat. The trim is monitored to ascertain that the boat's propulsion source, typically an outboard motor, is not in the trailering position and that the trim is properly configured "up" for shallow water. Finally, after the engine compartment blower is automatically started, the lower explosive level of the engine compartment is monitored to be at a safe level. If the boat is not correctly operatively configured then appropriate error warning messages are displayed. If the boat is correctly operatively configured for being started up, particularly in shallow water, then the ENGINE START-UP SEQUENCE 2300 is entered.

Figure 20:
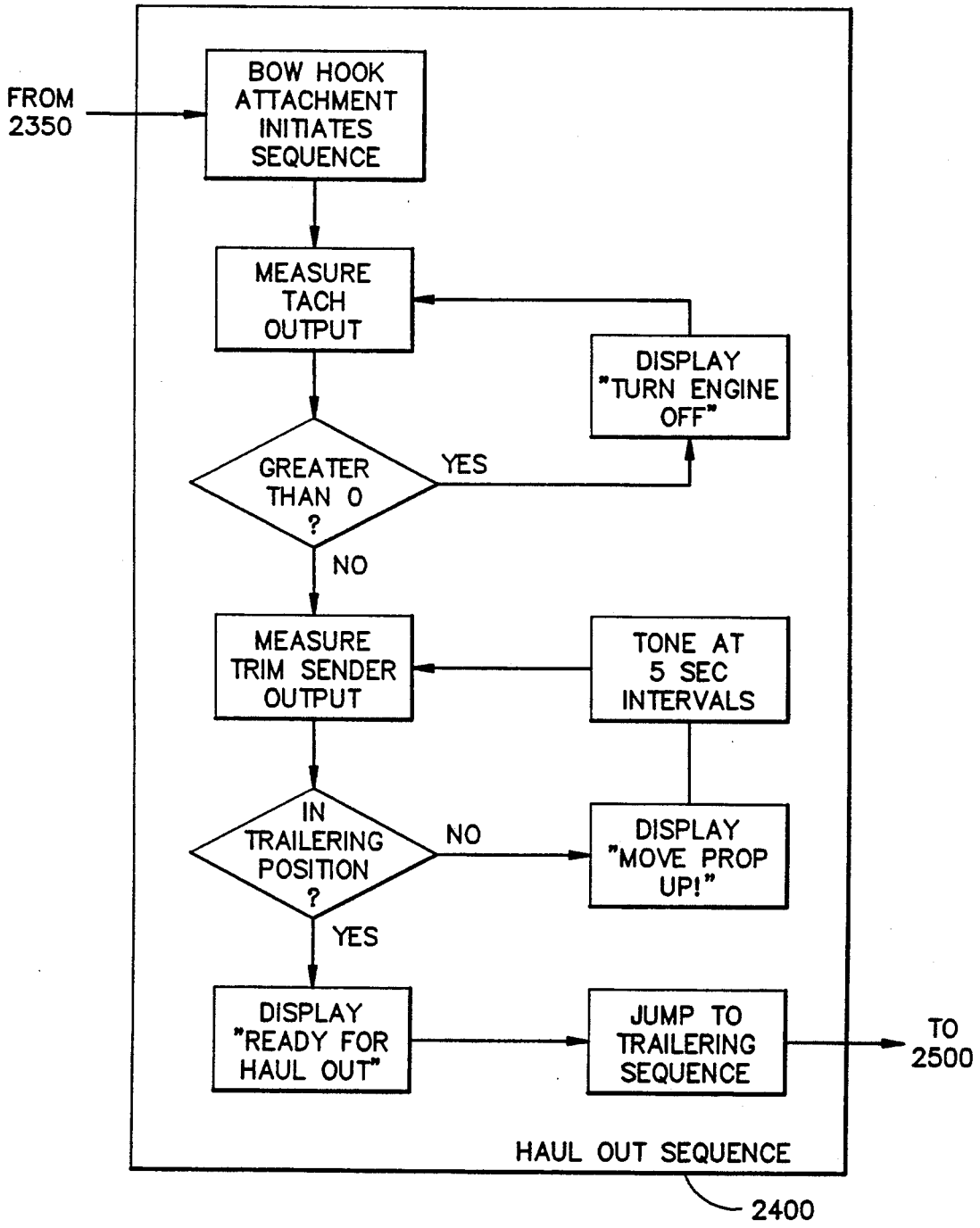
FIG. 20 is a third, bottom level flow chart showing the microcode particularly controlling the haul-out sequence of the safety system in accordance with the present invention.

The HAUL-OUT SEQUENCE 2400 of microprogrammed operations is block diagrammed in FIG. 20. Detection of the attachment of a bow hook by a bow hook sensor initiates the sequence. The engine operating sensor, typically a tachometer, is repetitively interrogated until the engine is turned off, displaying appropriate messages to the operator for so long as the engine is running. The trim of the boat's propulsion unit, typically an outboard motor, is monitored for being in the trailering, or "up" position For so long as the trim is not in the proper position an error message, typically an audible tone, is displayed. At such time as all conditions indicate the boat is suitably operatively configured for being hauled out of the water onto its land trailer, an appropriate message is displayed.

The HAUL OUT SEQUENCE 2400 block diagrammed in FIG. 20 may alternatively be adapted for control of the hoisting of a hoistable power boat onto and off of its hoist. The same quantities are typically sensed, with the ultimate message displayed being that the boat is suitably operatively configured for being hoisted out of the water by its hoist.

Figure 21A:
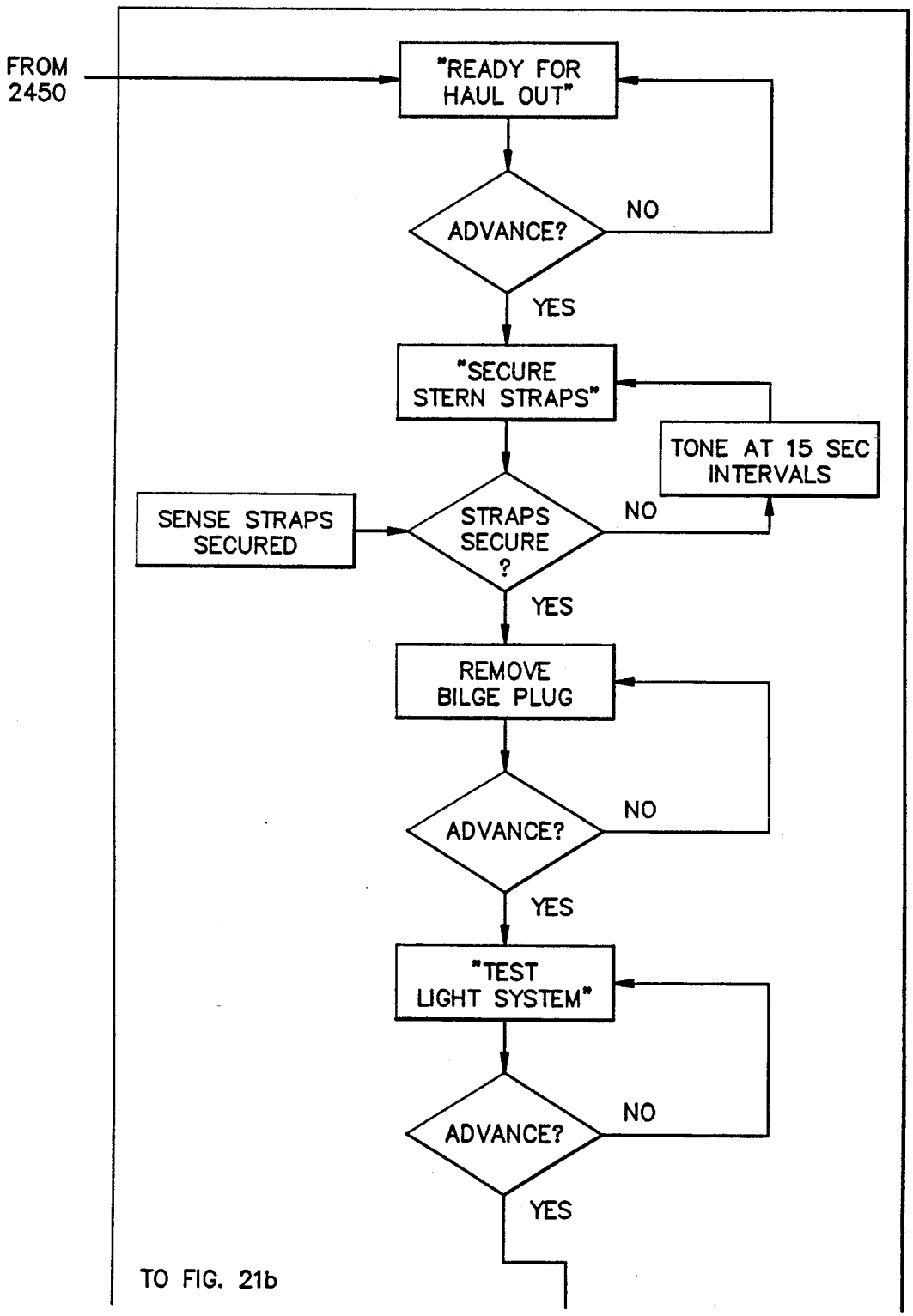
FIG. 21, consisting of FIG. 21*a* and FIG. 21*b*, is a third, bottom level flow chart showing the microcode particularly controlling the trailering sequence of the safety system in accordance with the present invention.
Figure 21B:
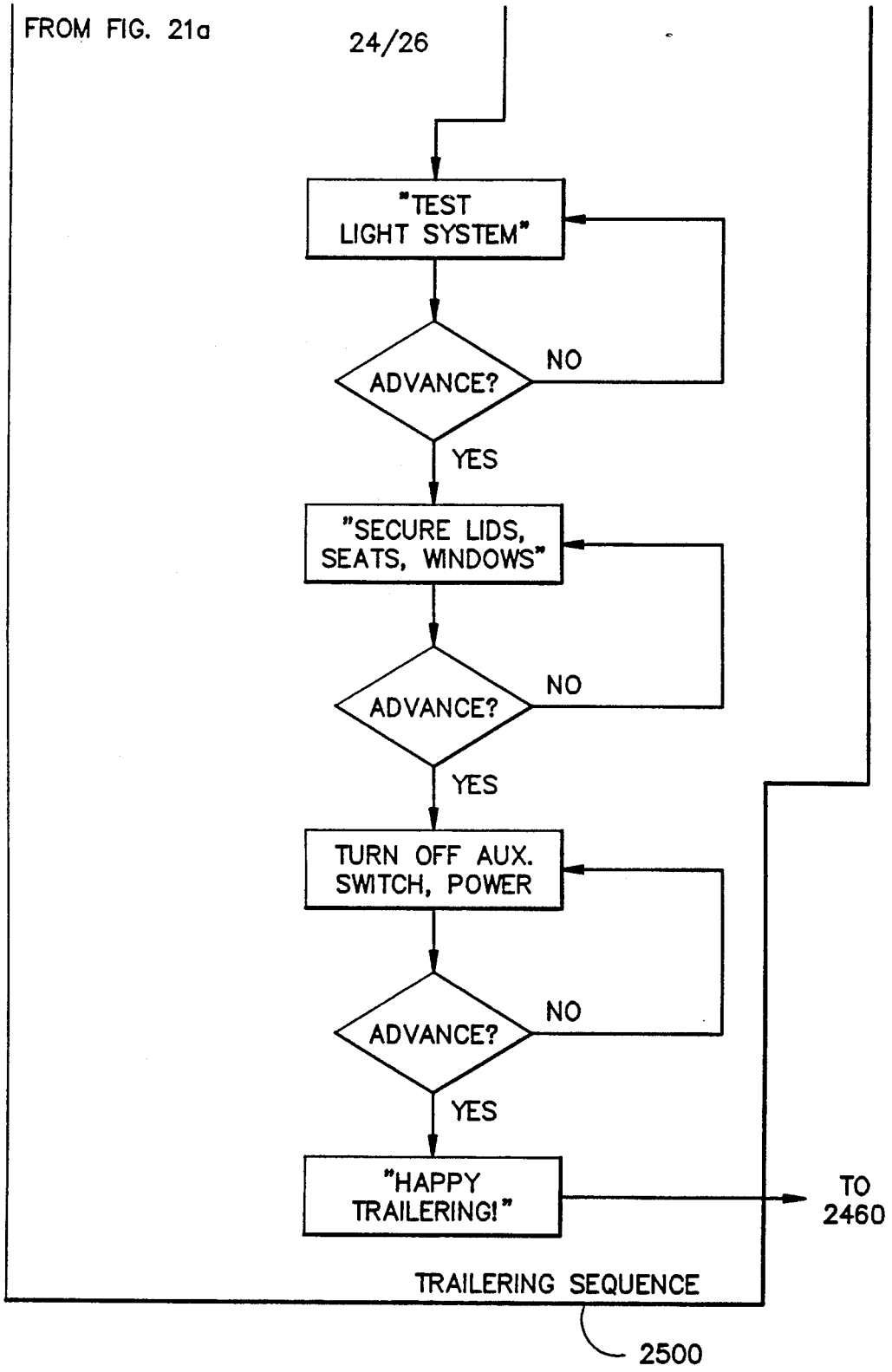

The TRAILERING SEQUENCE is block diagrammed in FIG. 21, consisting of FIG. **21*a* and FIG. 21*b***. This sequence monitors that the boat and its trailer are correctly operatively configured for being trailered upon the highways. A bow hook sensor had previously been monitored to determine that the power boat was correctly attached at its bow during the haulout sequence. The stern sensor is now monitored to determine that the power boat is correctly attached at its stern to its trailer. The bilge plug is monitored to be open, allowing flow communication between the bilge of the boat and the boats exterior, so that the boat, now resident upon its land trailer, may be drained of water. These sensed conditions alone are typically adequate to assure adequate safety during trailering. Additionally, however, the light system of the trailer may be tested, and the operator may be alerted to secure the lids, seats, windows and other items of the boat which might potentially fly loose during trailering. If the boat operates under auxiliary power, the operator may be alerted to disable such auxiliary power during trailering. These and other possible sensed conditions may be individual tailored as besuit the particular configuration and combination of a trailerable water craft and its trailer.

Figure 22:
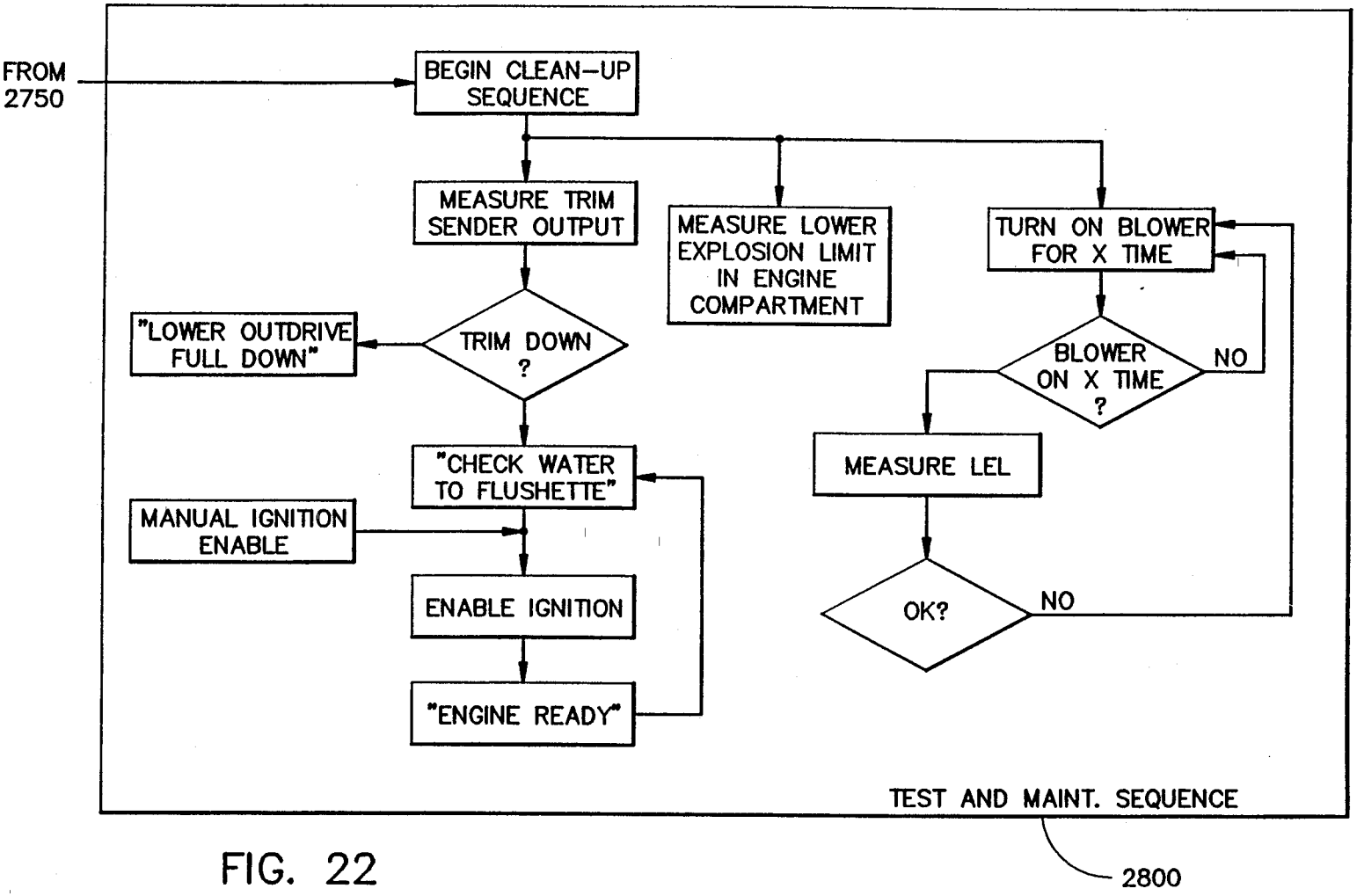
FIG. 22 is a third, bottom level flow chart showing the microcode particularly controlling the test and maintenance sequence of the safety system in accordance with the present invention.
Figure 23:
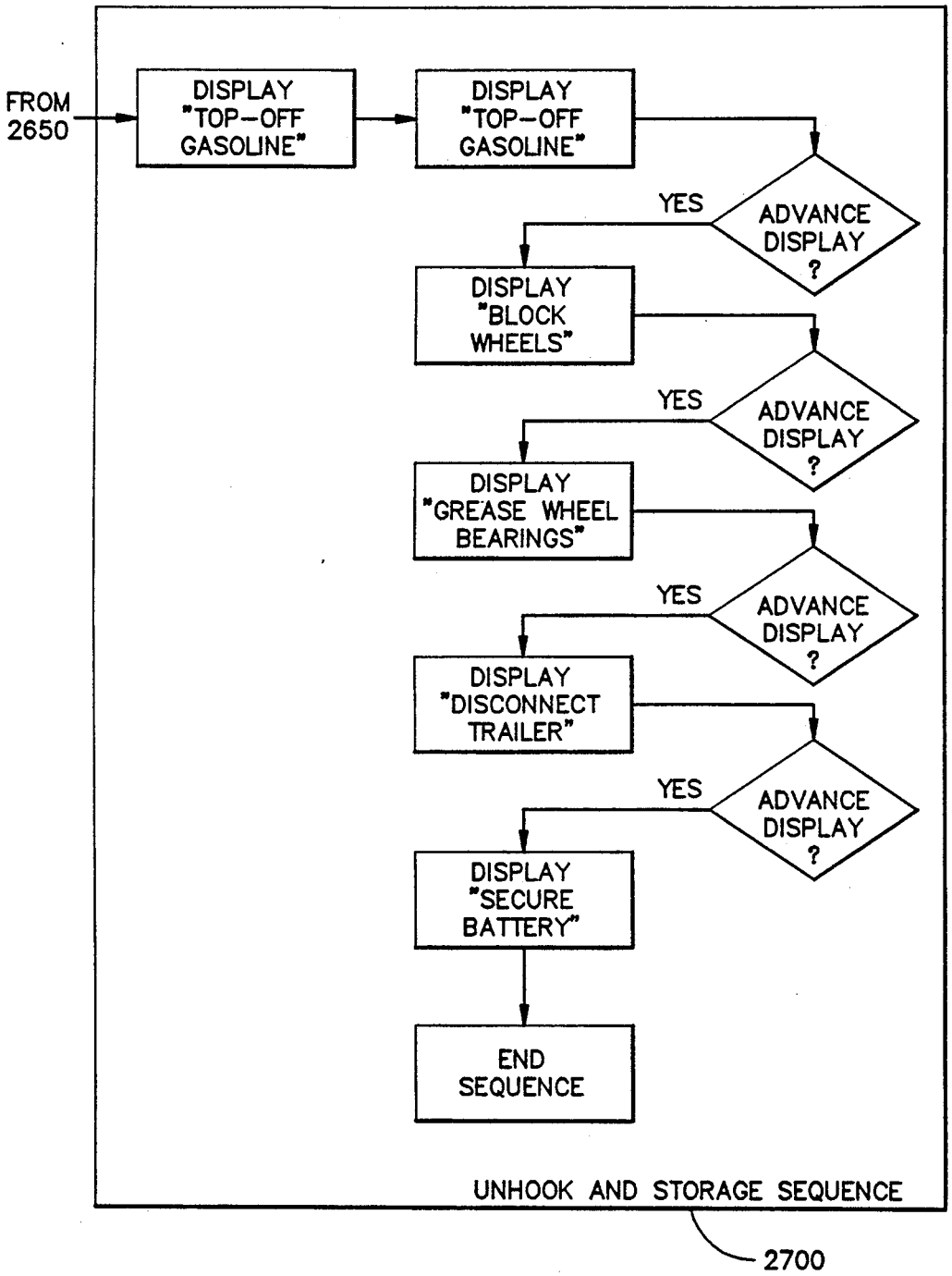
FIG. 23 is a third, bottom level flow chart showing the microcode particularly controlling the unhook and storage sequence of the safety system in accordance with the present invention.

A TEST AND MAINTENANCE SEQUENCE for the microprogrammed safety subsystem of the boat is block diagrammed in FIG. 22. An UNHOOK AND STORAGE sequence for the boat's safety subsystem is block diagrammed in FIG. 23. Both sequences exercise the flexible power of the multiple sensors and microprocessed operation of the safety subsystem in order to guide the boat owner/user in various procedures for testing, maintaining, unhooking, and/or storing his water craft. These sequences also are tailorable in accordance with the particular power boat, and the particular features of such boat, which are desired to be supported.

In accordance with the preceding discussion, the present invention will have been seen to be a flexible system for controlling the speed, acceleration, and/or trim of a power boat. Certain sensors, and particularly an electrically indicating accelerometer/inclinometer, have been seen to be preferred sensors in accordance with the present invention for use within the power boat control system. Finally, parts of the same control system that is otherwise used for power boat speed, acceleration, and/or trim control will have been seen to be useful in an operator interactive management and control safety subsystem supporting safe and efficient launching, use, recovery, trailering and/or storage of a power boat.

In accordance with the diverse aspects of the present invention, the invention should be interpreted in accordance with the language of the following claims, only, and not solely in accordance with those particular embodiments within which the invention has been taught.

What is claimed is:

1. A speed control system for a power boat comprising:

a pitot tube with its one end region positioned directionally longitudinally to the power boat's hull and within the water that the power boat transverses:

a pressure transducer flow connected to the other pitot tube end region for producing information on the actual speed of a power boat that is driven by a propulsion source in response to differing pressures sensed in the pitot tube with differing actual speeds of the power boat through the water:

data entry means responsive to manually entered data for producing information on the desired speed of the power boat;

processor means, receiving the actual and the desired speed information respectively from the speedometer and the pressure transducer, for producing speed error information on the direction and magnitude by which the actual power boat speed differs from the desired power boat speed; and boat propulsion control means, receiving the speed error information from the computer processor, for controlling the power boat propulsion source to make the actual speed more nearly equal to the desired speed.

2. A trim control system for a power boat having a hull mounting an outdrive propulsion comprising:

an inclinometer for producing information on the inclination of a hull of a boat relative to level, the inclinometer comprising:

an electrically conductive fluid;

a conduit for channeling the fluid in a flow path spatially oriented so that the fluid will assume different positions in its flow path under gravitational forces due to inclination and acceleration forces due to acceleration to which forces the conduit and its channeled fluid are variously subjected at various times;

a multiplicity of electrically conductive elements within the conduit in a multiplicity of positions located along the fluid flow path; and electrical means for detecting whether ones of the multiplicity of electrically conductive elements at corresponding ones of the multiplicity of positions are, or are not, electrically connected by a presence of the electrically conductive fluid at a particular position within its flow path that spans between said ones of the positions within the conduit, therein establishing electrical conduction between the ones of the multiplicity of electrically conductive elements, and a trim controller, receiving the inclination information from the inclinometer, for automatically adjusting a trim angle of the outdrive propulsion of the boat responsively to the inclination information in order that the trim angle of the boat's outdrive propulsion may better be maintained at a predetermined angle relative to level.

3. A trim control system for a power boat having a trimmable propulsion drive, the system comprising:

an inclinometer for sensing the inclination angle from level of the power boat along its fore-aft axis to produce inclination angle information, the inclinometer comprising:

an electrically conductive fluid;

a conduit for channeling the fluid in a flow path spatially oriented so that the fluid will assume different positions in its flow path under differing vector combinations of gravitational forces due to inclination and acceleration forces due to acceleration to which the conduit and its channeled fluid are variously subjected at various times;

a multiplicity of electrical connections to the fluid within the conduit in a multiplicity of positions located along the fluid flow path; and electrical means for detecting whether ones of the multiplicity of electrical connections to corresponding ones of the multiplicity of positions are, or are not, electrically connected by a presence of the electrically conductive fluid at a particular force-vector-determined position within its flow path that spans between said ones of the positions within the conduit, therein establishing electrical conduction between the ones of the multiplicity of electrical connections; and a trim controller, receiving the inclination information from the inclinometer, for controlling the trim of the power boat's trimmable propulsion drive in accordance with the inclination angle information to exert propulsive force in a direction substantially parallel to the surface of the water through which the power boat is propelled.

4. A speed control system for a power boat comprising:

speedometer means for producing information on the speed of a power boat that is driven by a propulsion source;

data entry means responsive to manually entered data of an arbitrary magnitude unrelated to the current speed of the power boat for producing information on any desired speed of the power boat within the total speed range of the power boat;

processor means, receiving the power boat speed and the desired speed information respectively from the speedometer and the data entry device, for producing speed error information on the direction and magnitude by which the power boat speed differs from the desired speed; and boat propulsion control means, receiving the speed error information from the computer processor, for controlling the power boat propulsion source to make, over time, the power boat speed to become more nearly equal to the desired speed, howsoever great any initial difference between these speeds.

5. The speed control system according to claim 4 wherein the data entry means comprises:

a manual keyboard responsive to manually entered data for producing the desired speed information.

6. The speed control system according to claim 4 wherein the processor means comprises:

a digital computer.

7. The speed control system according to claim 6 wherein the digital computer comprises:

a microprocessor.

8. The speed control system according to claim 4 wherein the data entry means is responsive to differing manually entered data to produce a plurality of differing informational quantities on a corresponding plurality of different desired speeds of the boat; and wherein the processor means receives the plurality of differing desired speed informational quantities from the data entry means, stores these differing informational quantities, and is controllable for using selectable ones of the plurality of desired speed informational quantities at separate times to develop the speed error information; and wherein the speed control system further comprises:

selection means for controlling the processor means as to which selectable ones of the plurality of desired speed informational quantities are to be used to develop the speed error information.

9. The speed control system according to claim 4 wherein the boat propulsion control means comprises:

a source of motive power for controlling a throttle of an engine propulsion source of the power boat.

10. The speed control system according to claim 4 expanded for the further control of acceleration/deceleration, the expanded system according to claim 4 comprising:

clock means for producing time information;

wherein the data entry means is further responsive to additionally manually entered data for further producing additional information on the desired acceleration/deceleration of the power boat;

wherein the processor means is further receiving desired acceleration/deceleration information from the data entry means and the time information from the clock means, is further producing from this time information and also from successive speed information received over a time interval the actual acceleration/deceleration of the power boat, is further producing acceleration/deceleration error information on the direction and magnitude by which the actual power boat acceleration/deceleration differs from the desired acceleration/deceleration information, and is using this acceleration/deceleration error information in producing the speed error information;

wherein the use of the acceleration/deceleration error information by the processor means in producing the speed error information is so as to affect speed control of the power boat, when such speed error information is used by the boat propulsion control means, that makes the actual acceleration/deceleration of the power boat approximate the desired acceleration/deceleration while the power boat accelerates/decelerates to the desired speed.

11. The speed control system expanded for control of acceleration/deceleration according to claim 10 wherein the data entry means is producing information on a plurality of desired accelerations/decelerations; and wherein the processor means is using at one time a selected one of the plurality of desired accelerations/decelerations to produce the acceleration/deceleration error information.

12. The speed control system according to claim 4 expanded for the further control of acceleration/deceleration, the expanded system according to claim 4 comprising:

accelerometer means for producing information on the actual acceleration/deceleration of the power boat;

wherein the data entry means is further responsive to additionally manually entered data for producing additional information on the desired acceleration/deceleration of the power boat;

wherein the processor means is further receiving desired acceleration/deceleration information from the data entry means and the actual acceleration/deceleration information from the accelerometer means, and is further producing acceleration/deceleration error information on the direction and magnitude by which the actual power boat acceleration/deceleration differs from the desired acceleration/deceleration information, and is using this acceleration/deceleration error information in producing the speed error information;

wherein the use of the acceleration/deceleration error information by the processor means in producing the speed error information is so as to affect speed control of the power boat that, when such speed error information is used by the engine control means, that makes the actual acceleration/deceleration approximate the desired acceleration/deceleration while the power boat accelerates/decelerates to the desired speed.

13. The speed control system expanded for control of acceleration/deceleration according to claim 12 wherein the accelerometer means comprises:

an electrically conductive fluid;

a conduit for channeling the fluid in a flow path spatially oriented so that the fluid will assume different positions in its flow path under gravitational forces due to inclination and acceleration forces due to acceleration to which forces the conduit and its channeled fluid are variously subjected at various times;

a multiplicity of electrically conductive elements within the conduit in a multiplicity of positions located along the fluid flow path; and electrical means for detecting whether ones of the multiplicity of electrically conductive elements of corresponding ones of the multiplicity of positions are, or are not, electrically connected by a presence of the electrically conductive fluid at a particular position within its flow path that spans between said ones of the positions within the conduit, therein establishing electrical conduction between the ones of the multiplicity of electrically conductive elements.

14. The speed control system expanded for control of acceleration/deceleration according to claim 12 wherein the data entry means is producing information on a plurality of desired accelerations/decelerations; and wherein the processor means is using at one time a selected one of the plurality of desired accelerations/decelerations to produce the acceleration/deceleration error information.

* * * * *